US009140049B2

(12) United States Patent
Suggs

(10) Patent No.: US 9,140,049 B2
(45) Date of Patent: Sep. 22, 2015

(54) SAFE STORAGE PANELS

(71) Applicant: Rhino Metals, Inc., Caldwell, ID (US)

(72) Inventor: Donald Suggs, Boise, ID (US)

(73) Assignee: Rhino Metals, Inc., Caldwell, ID (US)

( * ) Notice: Subject to any disclaimer, the term of this patent is extended or adjusted under 35 U.S.C. 154(b) by 0 days.

(21) Appl. No.: 14/514,173

(22) Filed: Oct. 14, 2014

(65) Prior Publication Data

US 2015/0101516 A1 Apr. 16, 2015

Related U.S. Application Data

(60) Provisional application No. 61/891,321, filed on Oct. 15, 2013.

(51) Int. Cl.

| | |
|---|---|
| ***E05G 1/04*** | (2006.01) |
| ***E05G 1/06*** | (2006.01) |
| ***E05G 1/024*** | (2006.01) |
| ***E05G 1/026*** | (2006.01) |
| ***A47B 46/00*** | (2006.01) |

(52) U.S. Cl.

CPC . *E05G 1/06* (2013.01); *A47B 46/00* (2013.01); *E05G 1/024* (2013.01); *E05G 1/026* (2013.01)

(58) Field of Classification Search

CPC ..... A47B 46/00; A47B 81/00; A47B 81/005; E05G 1/00; E05G 1/04

USPC ..... 109/45, 47, 50, 51; 211/4, 64; 312/334.28, 334.24, 404

See application file for complete search history.

(56) References Cited

U.S. PATENT DOCUMENTS

| | | | | |
|---|---|---|---|---|
| 2,040,634 | A * | 5/1936 | Sekyra | 62/382 |
| 2,233,699 | A * | 3/1941 | Gorrell | 292/227 |
| 2,575,530 | A * | 11/1951 | Reid | 312/225 |
| 3,078,133 | A * | 2/1963 | Schauer | 312/321.5 |
| 4,113,107 | A * | 9/1978 | Jaeger | 211/4 |
| 4,461,385 | A * | 7/1984 | Clouser | 211/4 |
| 5,057,977 | A | 10/1991 | Kurzman | |
| 5,145,245 | A * | 9/1992 | Fierthaler | 312/321.5 |
| 5,626,379 | A * | 5/1997 | Scott | 294/143 |
| 6,042,207 | A | 3/2000 | Crosby et al. | |
| 6,076,906 | A | 6/2000 | Royal | |
| 6,220,682 | B1 | 4/2001 | Vertullo | |
| 7,409,790 | B2 | 8/2008 | Stepp | |
| 2003/0151336 | A1* | 8/2003 | Freeman | 312/310 |
| 2004/0140280 | A1* | 7/2004 | Cleveland et al. | 211/64 |
| 2005/0133473 | A1* | 6/2005 | Lesperance | 211/64 |
| 2006/0283820 | A1* | 12/2006 | Peters et al. | 211/64 |

(Continued)

FOREIGN PATENT DOCUMENTS

WO WO 9413175 A1 * 6/1994 ..... A47B 83/00

*Primary Examiner* — Suzanne Barrett

(74) *Attorney, Agent, or Firm* — Phillips Ryther & Winchester; Matthew D. Thayne

(57) ABSTRACT

Safes and related storage panels for safes, such as gun safes. Some embodiments may comprise a safe door and an interior storage panel configured to be positioned between a closed position and an open position by rotating the interior storage panel. The interior storage panel may be configured so as to be positioned within the safe in the closed position such that the safe door can be closed in the closed position, and so as to be positioned at least partially outside of the safe in the open position when the safe door is open. In some embodiments, the interior storage panel may be configured so as to extend along and be positioned at least substantially parallel to the safe door in the closed position with the safe door closed.

20 Claims, 19 Drawing Sheets

(56) References Cited

U.S. PATENT DOCUMENTS

| | | | | |
|---|---|---|---|---|
| 2007/0000851 | A1* | 1/2007 | Matzick | 211/64 |
| 2010/0122960 | A1* | 5/2010 | Bliss | 211/64 |
| 2011/0037360 | A1* | 2/2011 | Jakins et al. | 312/237 |
| 2011/0168649 | A1* | 7/2011 | Stolz | 211/4 |
| 2012/0086318 | A1* | 4/2012 | Tassin et al. | 312/249.7 |
| 2012/0223626 | A1* | 9/2012 | Thomas | 312/242 |
| 2013/0002116 | A1* | 1/2013 | Lodge et al. | 312/351.1 |
| 2013/0298808 | A1* | 11/2013 | Tan et al. | 109/63.5 |
| 2014/0027394 | A1* | 1/2014 | Stepp et al. | 211/64 |
| 2014/0132131 | A1* | 5/2014 | Thomas | 312/204 |
| 2014/0327350 | A1* | 11/2014 | Tassin et al. | 312/249.7 |

* cited by examiner

SAFE STORAGE PANELS

RELATED APPLICATIONS

This application claims the benefit under 35 U.S.C. §119 (e) of U.S. Provisional Patent Application 61/891,321 filed Oct. 15, 2013 and titled "SAFE STORAGE PANELS," which application is incorporated herein by reference in its entirety.

BRIEF DESCRIPTION OF THE DRAWINGS

The written disclosure herein describes illustrative embodiments that are non-limiting and non-exhaustive. Reference is made to certain of such illustrative embodiments that are depicted in the figures, in which.

DETAILED DESCRIPTION

Figure 1:
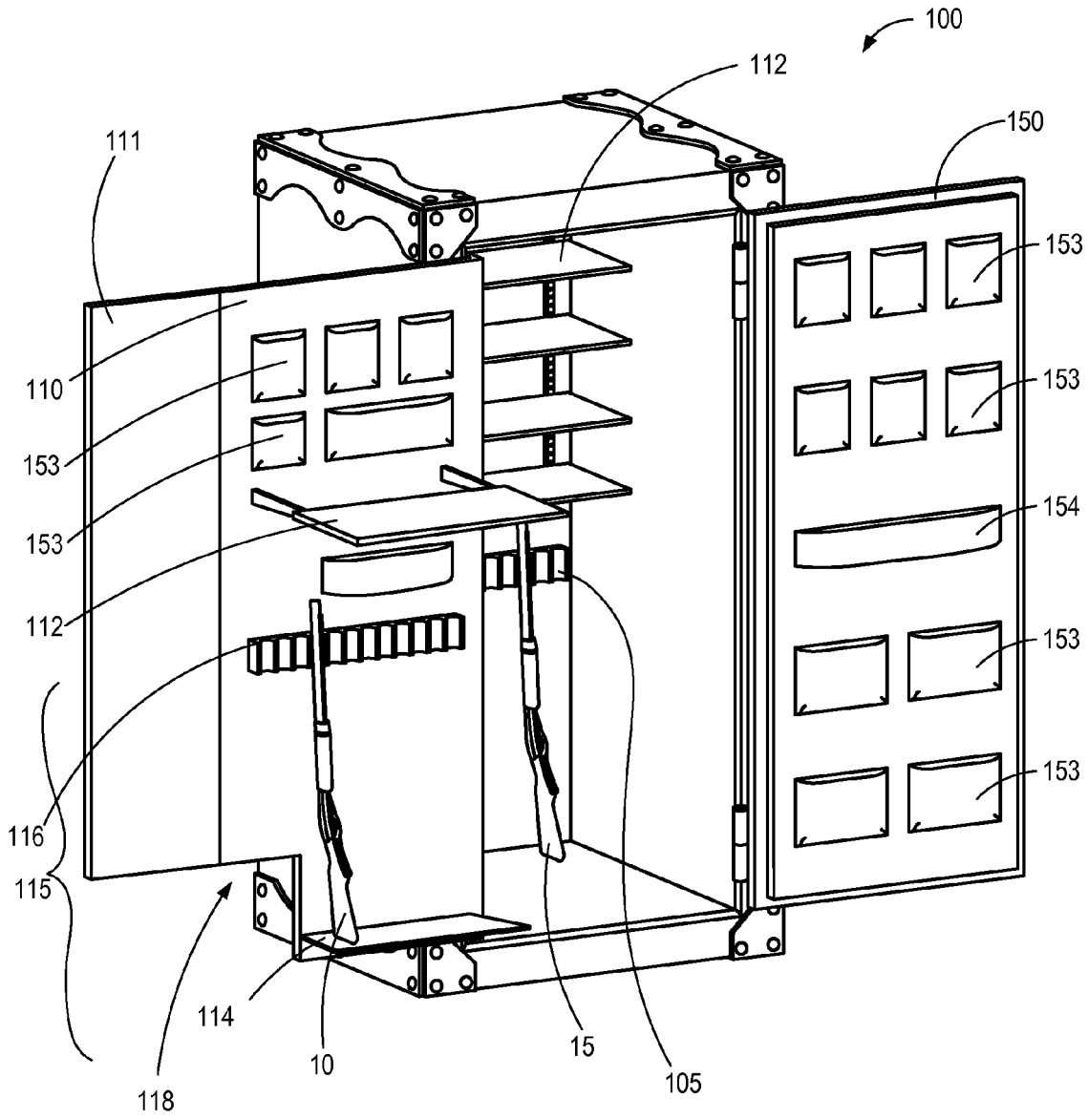
FIG. 1 is a perspective view of a safe comprising an interior storage panel according to one embodiment.

A detailed description consistent with various embodiments of the present disclosure is provided below. It will be readily understood that the components of the present disclosure, as generally described and illustrated in the drawings herein, could be arranged and designed in a wide variety of different configurations. Thus, the following more detailed description of the embodiments of the apparatus is not intended to limit the scope of the disclosure, but is merely representative of possible embodiments of the disclosure. In addition, while numerous specific details are set forth in the following description in order to provide a thorough understanding of the embodiments disclosed herein, some embodiments can be practiced without some or all of these details. Moreover, for the purpose of clarity, certain technical materials, structures, or operations that are known in the related art have not been shown or described in detail in order to avoid unnecessarily obscuring the disclosure.

Various embodiments are disclosed herein of safes comprising one or more movable interior storage panels. In some embodiments, the safes may be specifically configured for storing guns or other weapons. As discussed in greater detail below, in some embodiments, the interior storage panels may be configured to provide for storing items, such as guns, ammunitions, gun accessories, and the like. In some embodiments, the interior storage panels may be pivotably movable from a stored or closed position in which the storage panel is entirely positioned within the interior of the safe to allow the safe door to be closed to an exterior position in which at least some of the storage panel is positioned outside of the safe to allow for easier access to the items stored on the panel and/or maximize storage area within the safe. In some embodiments, the panel(s) may be configured such that, in the exterior position, the panel(s) is wholly positioned outside of the safe.

Certain embodiments of safes incorporating such panels will now be discussed in greater detail with reference to the accompanying drawings. FIG. 1 is a perspective view of an embodiment of a safe 100 incorporating a storage panel 110. Storage panel 110 is shown in the figure in an open position. As described in greater detail below, this position may be reached by first opening safe door 150 and then rotating/swinging panel 110 outside of safe 100. Thus, panel 110 is configured to be completely stored within safe 100 when safe door 150 is closed and then swung open such that panel 110 is at least substantially positioned outside of safe 100 when safe door 150 has been opened and panel 110 has been swung open.

Safe door 150 may comprise a plurality of pockets, pouches, straps, drawers, shelves, or other storage means. In the depicted embodiment, for example, safe door 150 comprises a plurality of storage pockets 153 and a strap 154. Because safe 100 comprises a gun safe, these means for storing comprise means for storing guns and/or gun accessories. For example, storage pockets 153 may be used to hold ammunition, pistols, holsters, sights, and the like.

Panel 110 may also comprise a plurality of pockets 153 or other storage means. For example, panel 110 also comprises a shelf 112. One or more such shelves may be extendable, collapsible, rotatable, or otherwise configured to be positioned in a first condensed configuration and a second expanded configuration to allow for accommodation of other storage items and/or interior space constraints within safe 100, such as clearing rifle barrels stored within safe 100. For example, in some embodiments, one or more shelves 112 may be telescoping or otherwise extendable, as shown in FIG. 1, to allow for resizing such shelves as desired. In other embodiments, one or more shelves 112 may be rotatable/pivotable to allow for storage in a collapsed position, such as against panel 110, and then rotated/pivoted to a position perpendicular to panel 110 once panel 110 has been positioned outside of the interior space of safe 100. One or more shelves 112 may also, or alternatively, be adjustable in position and/or height, such as adjustable between shelves to adjust the spacing therebetween. One or more shelves 112 may also, if desired, be placed within the interior space of safe 100, as also depicted in FIG. 1.

Storage panel 110 may further comprise a vertical gun rack 115, which may be positioned on either or both sides of panel 110. Other embodiments are contemplated in which panel 110 may comprise more than two sides. For example, in some embodiments, panel 110 may have a rectangular or other polygonal cross-sectional shape. Thus, one or more gun racks or other storage means may be placed on any side/surface of panel 110 as desired.

Gun rack 115 may comprise a stock rest 114 and a barrel rest 116 comprising a plurality of slots each configured to receive a portion of a rifle barrel. In some embodiments, stock rest 114 may similarly be configured with a corresponding plurality of inserts configured to receive the stock of a rifle. One or more similar gun racks, such as gun rack 105, may be positioned within an interior space of safe 100. Gun rack 105 lacks a stock rest because such gun stocks may be positioned adjacent to a bottom floor/wall of safe 100. However, in other embodiments, a stock rest, such as a stock rest similar to stock rest 114, may be provided for gun rack 105 as well.

In the depicted embodiment, panel 110 further comprises a cutout region 118. Cutout region 118 may be configured to accommodate the stock of a rifle stored within the interior space of safe 100, so as to maximize the available space within safe 100. For example, with reference to the embodiment of FIG. 1, another gun rack 105 or array of racks may be positioned within safe 100, such as along a rear surface and or side surface of safe 100. Depending upon the dimensions of safe 100 and/or storage panel 110, without providing cutout region 118, stock rest 114 and/or the stock of one or more guns 10 stored on panel 110 may interfere with the stock of one or more guns 15 or other items stored within and/or used as storage means for safe 100. In other embodiments, instead of or in addition to providing such a cutout region 118, panel 110 may be tapered and/or curved from top to bottom, either continuously or in steps, such that, unlike panel 110, the storage panel may not comprise a rectangular shape.

In the embodiment of panel 110 depicted in FIG. 1, a movable section 111 is also provided. Movable section 111 may be removable, slideable, hinged, telescoping or otherwise movable. In addition, although section 111 is shown positioned laterally with respect to panel 110, one or more such panels may be alternatively, or additionally, positioned on upper and/or lower portions of panel 110. In some embodiments, movable section 111 may be modular such that a base storage panel 110 may be used in connection with a number of different safes having differed shapes and/or sizes. One or more modular sections 111 may then be attached to panel 110 to provide further storage area as needed and/or to more suitably fit within a safe of various different sizes. In embodiments in which modular sections are provided, they may be coupled with a storage panel by way of, for example, bolts, screws, pins, slots, or the like. In some embodiments, panel 111 need not be slidable but may still be considered modular. In other words, one or more such modular sections may be added to a relatively small interior storage panel such that the same panel may be used with larger safes by adding on one or more modular sections.

Figure 2:
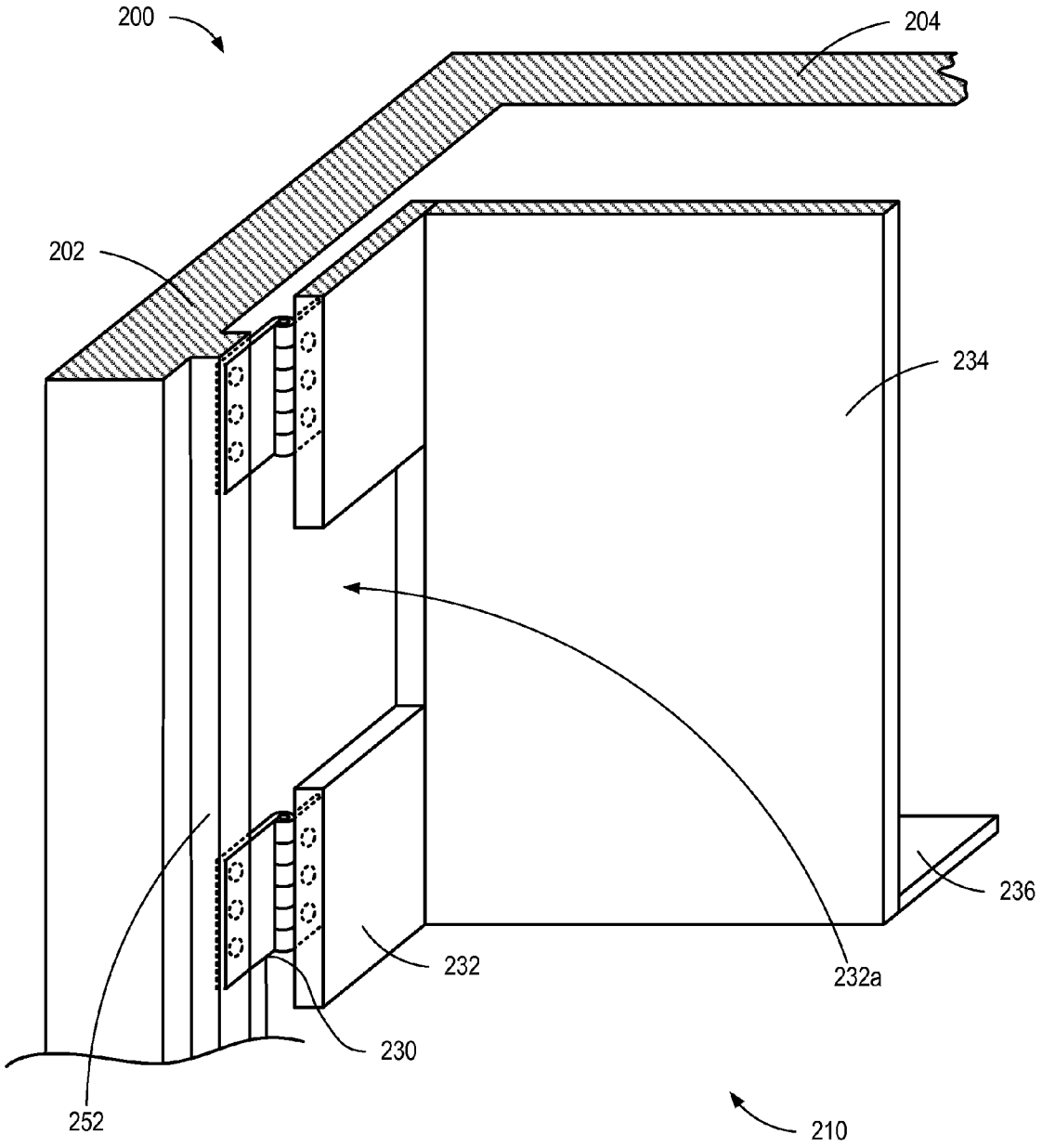
FIG. 2 is a partial, cross-sectional view of an interior storage panel and an accompanying set of hinges according to another embodiment.

FIG. 2 is a partial, cross-sectional view depicting one example of a means for articulating an interior safe storage panel. As shown in this figure, panel 210 comprises a plurality of hinges 230. Of course, in alternative embodiments, a single hinge 230 or other pivotable coupling means may be provided instead. Hinges 230 are attached to a first panel member 232 at one end and to a portion of safe door frame 252 at the other end. Panel 210 may further comprise a second panel member 234 coupled with first panel member 232. In the depicted embodiment, first panel member 232 extends at an angle with respect to second panel member 234 that is at least substantially perpendicular. In this manner, as depicted in FIG. 2 (which depicts panel 210 in a closed position within safe 200), when stored within an interior space of safe 200, panel 210 may be positioned such that first panel member 232 extends at least substantially parallel to a sidewall 202 of safe 200. In the depicted embodiment, panel 210 is also configured such that, in the stored position, second panel member 234 extends at least substantially parallel to a rear wall 204 of safe 200. Of course, other embodiments are contemplated in which this need not be the case.

Panel 210 further comprises a base 236, which may be used to further facilitate storage of items such as guns, gun accessories, and the like. For example, the stock of one or more rifles may be rested against base 236. In the depicted embodiment of FIG. 2, base 236 extends at least substantially perpendicular to both first panel member 232 and second panel member 234.

Some embodiments may comprise more than two panel members. In some embodiments, one or more of the panel members may be retractable/extendable. In this manner a storage panel may be configured to be customizable so as to maximize the available space within a space. For example, if guns or other items are positioned against a rear wall of a safe, such as rear wall 204 of safe 200, a panel member, such as first panel member 232, may be shortened to accommodate such items. Similarly, if there are no items stored immediately adjacent to rear wall 204, first panel member 232 may be lengthened to, for example, accommodate items in between safe panel 210 and the safe door (not shown in FIG. 2) while safe 200 is locked. In some such embodiments, one or more of the panel members may be telescoping or otherwise configured to accommodate such extending/retracting, using any such means available to one of ordinary skill in the art. For example, in some embodiments, first panel member 232 may be coupled with second panel member 234 using an adjustable coupling means, such as an extendable post, telescoping coupling mechanism, slotted holes, etc.

First panel member 232 comprises a cut-out section 232*a*. Cut-out section 232*a* may be provided so as to accommodate one or more locking bolts (not shown in FIG. 2) that may be configured to extend through a portion of safe door frame 252 or another portion of the safe. Without providing this cut-out section 232*a*, first panel member 232 may block such locking bolt(s).

Figure 3:
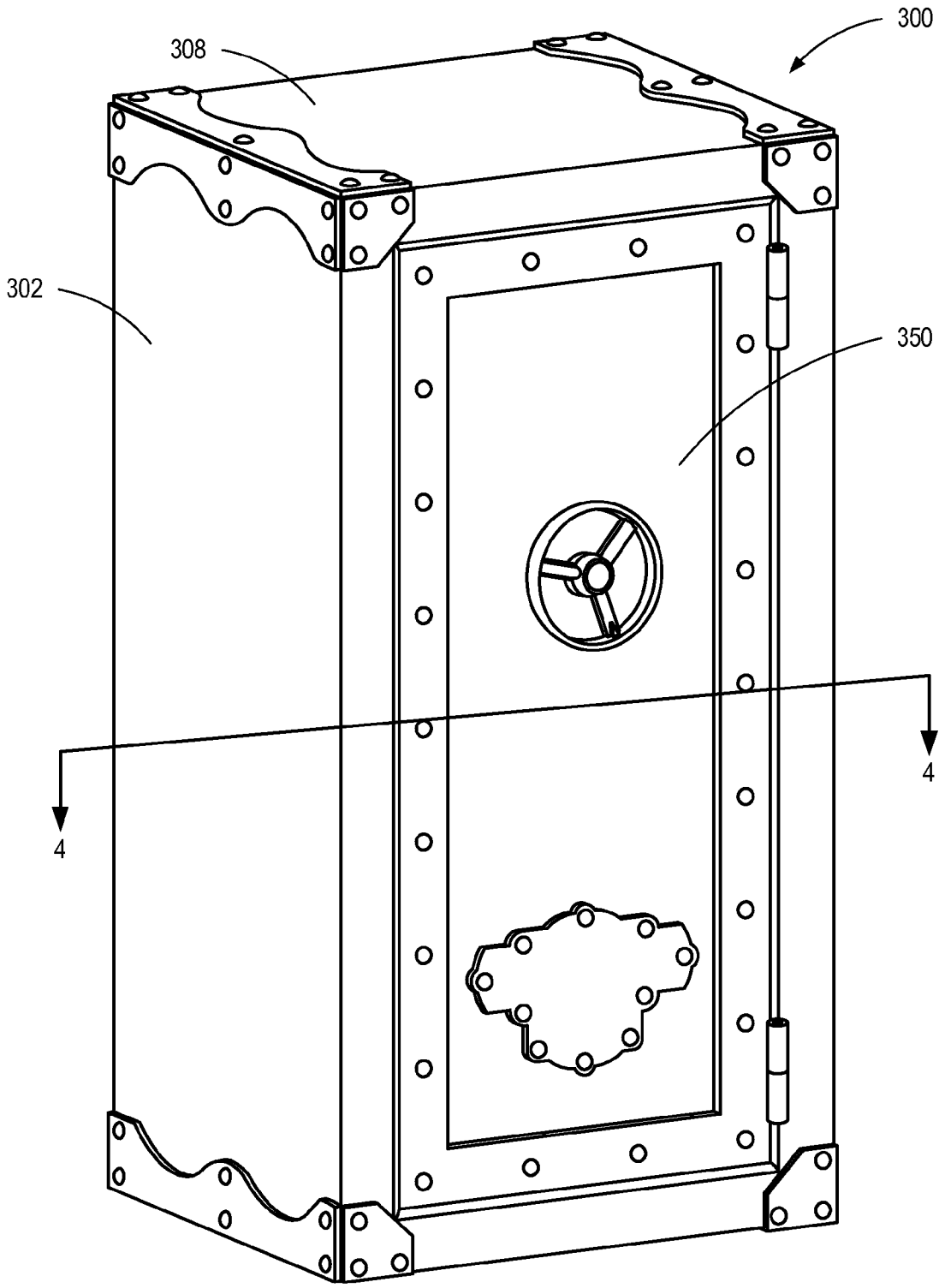
FIG. 3 is a perspective view of a safe comprising an interior storage panel according to still another embodiment.
Figure 4:
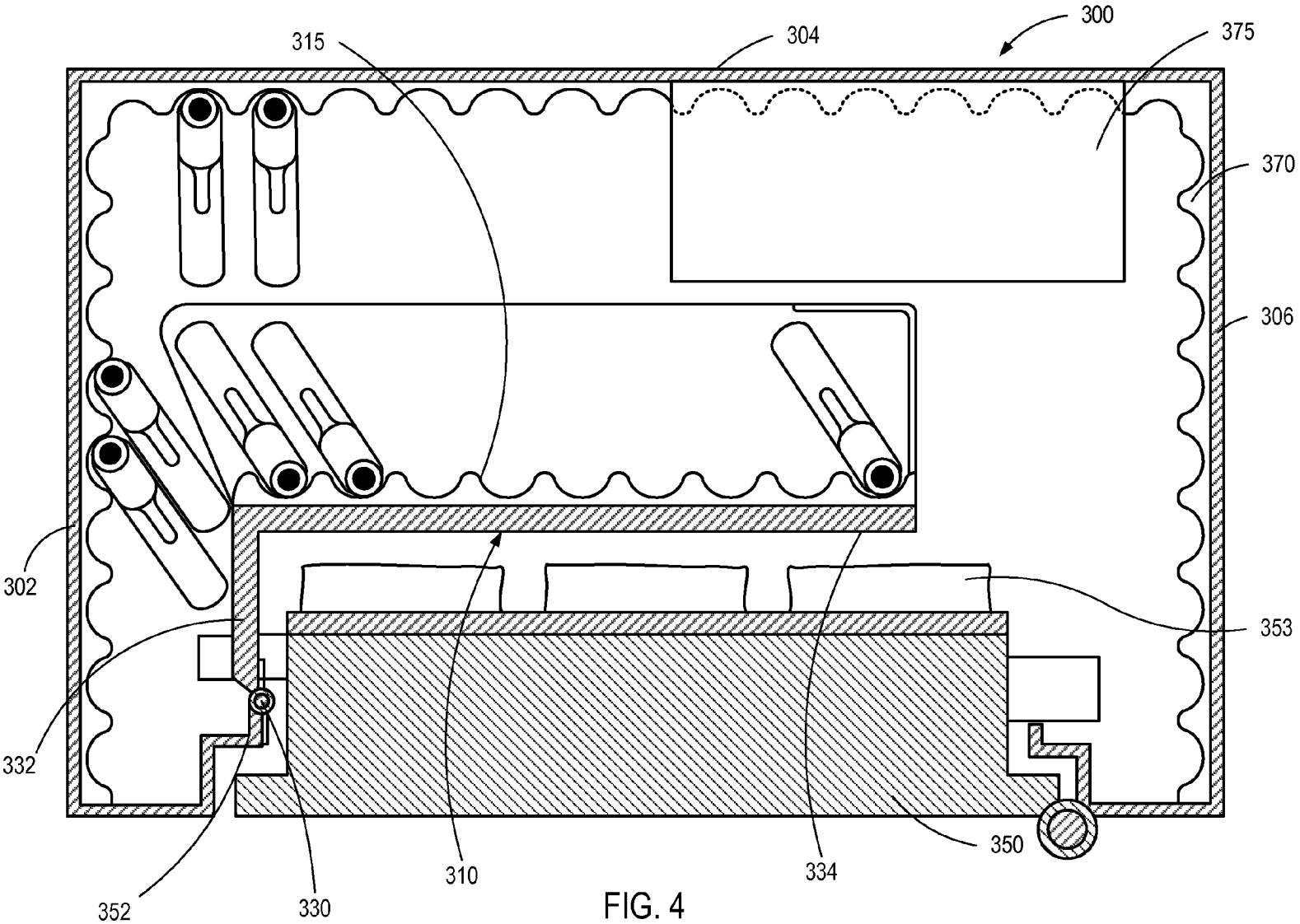
FIG. 4 is a cross-sectional view taken along line 4-4 in FIG. 3.

FIG. 3 is a perspective view of another embodiment of a safe 300 comprising a storage panel (not shown in FIG. 3). FIG. 3 depicts safe 300 in a closed position. FIG. 4 is a cross-sectional view of safe 300 taken along line 4-4 in FIG. 3. As shown in this figure, storage panel 310 is positioned within an internal space of safe 300 when safe door 350 is closed. Panel 310 comprises a first panel member 332 and a second panel member 334. Of course, as those of ordinary skill will appreciate after having reviewed this disclosure in its entirety, some embodiments may comprise a single panel member, or more than two panel members. First panel member 332 extends at an angle with respect to second panel member 334 that is at least substantially perpendicular. In addition, in the closed configuration, first panel member 332 extends at least substantially parallel to a sidewall 302 of safe 300 and at least substantially perpendicular to rear wall 304. Similarly, panel 310 is configured such that, in the closed configuration, second panel member 334 extends at least substantially parallel to rear wall 304, and at least substantially perpendicular to sidewall 302.

However, several alternative embodiments are contemplated. For example, in some embodiments, panel 310, or at least one panel member of panel 310, may extend parallel to an inner surface of upper wall (308 in FIG. 3) or floor of safe 300 when in a closed configuration. In this manner, particularly for large/tall safes, the space within a safe near the top of the safe, which may otherwise not be easily reachable, may be occupied by one or more panels.

Panel 310 also comprises one or more hinges 330. Hinge 330 is coupled to first panel member 332 at one end and to a portion of safe door frame 352 at the other end. Of course, in other embodiments, hinge 330, or another similar coupling means, may be coupled instead to another portion of the safe body, such as sidewall 302. Hinge 330 may allow for panel 310 to swing open after door 350 has been opened, as previously described. Hinges 230 and 330 are both examples of means for pivotably moving an internal safe storage panel from an interior portion of a safe to an exterior portion of a safe.

Panel 310 also comprises a gun storage rack 315, which may be used to hold or otherwise store one or more guns. Other similar storage mechanisms may be provided in other areas of safe 300. For example, a rack 370 or array of such racks may be positioned around one or more interior surfaces of safe 300. In the embodiment depicted in FIG. 4, rack 370 extends around the interior surface of rear wall 304 and opposing sidewalls 302 and 306. One or more shelves 375 may also be positioned within safe 300.

One or more means for storing firearms and/or firearms accessories, such as ammunition, scopes, sights, gun cleaning accessories, and the like, may be positioned within or along one or more portions/elements of safe 300. For example, an interior surface of safe door 350 may comprise one or more pockets 353, as previously described.

FIGS. 5-13 depict cross-sectional views of a number of alternative embodiments of safe storage panels. Each of the safe storage panels depicted in these figures is configured to be stored entirely within a locked safe in a closed configuration and completely removed from the interior space of the safe in an open configuration. However, still other alternative embodiments are contemplated in which such panels may be only partially removed from the interior space in the open configuration. Each of these alternative embodiments also comprises a plurality of joints/pivot points interconnected by one or more link arms. These embodiments thereby provide added flexibility in the positioning of the storage panels, both within their respective safes when closed and outside, or at least partially outside, of their respective safes when the doors to such safes are open. Although for simplicity, FIGS. 5-13 do not depict safe doors, it is expected that each of these embodiments will comprise a separate safe door and that the depicted storage panels may be completely inserted within their respective safes, and the respective safe doors closed and locked, in a storage/locked position.

Figure 5:
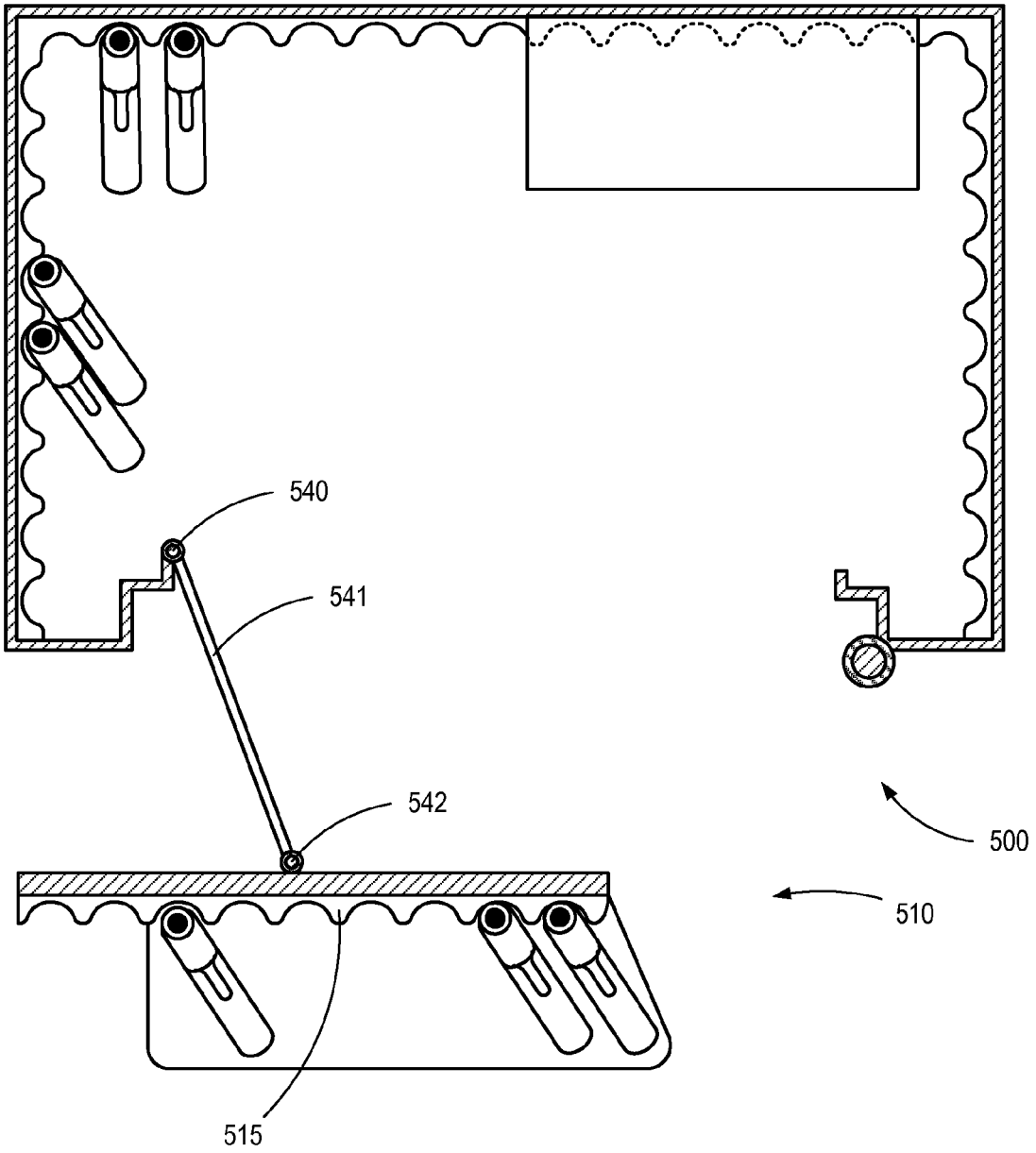
FIG. 5 is a cross-sectional view of another safe comprising an alternative interior storage panel.

FIG. 5 depicts a safe 500 comprising a storage panel 510. Storage panel 510 comprises a gun rack 515, which may be similar to those previously described. However, storage panel 510 differs from the previously-described panels in that panel 510 is configured to pivot about two joints—joints 540 and 542—which are interconnected by a link arm 541. Joints 540 and 542, along with any of the other joints described herein, may comprise, for example, ball and socket joints, hinges, and the like. In some embodiments, these joints may be configured to provide for rotation within only one axis. However, other embodiments are contemplated in which the joints may be configured to provide for pivoting/rotation within more than one axis. The combination of joints and link arms disclosed herein are additional examples of means for pivotably moving an internal safe storage panel from an interior portion of a safe to an exterior portion of a safe.

In some embodiments, one or more of the link arms or other link members, such as link arm 541, and/or one or more of the panel members, may be adjustable. For example, in some embodiments, the length, shape, and/or another dimension of one or more of the link arms may be adjustable. This may be accomplished, for example, by providing a telescoping mechanism. In some embodiments, one or more of the link arms may comprise one or more springs and/or pistons. In some such embodiments, one or more link arms may be supported by a gas spring that may be coupled at one end to the link arm(s) and coupled at the opposite end to a joint and/or a coupling mechanism configured to join the spring to the joint. In some embodiments, the link arm(s) may comprise an at least partially hollow axis to accommodate a piston or spring, which may, in turn, be coupled to the joint.

In some embodiments, the joint may be ratcheted or otherwise stepped so as to result in a discrete number of adjustment positions. In other embodiments, the number of adjustment positions may be infinite, or at least indefinite. In other words, in such embodiments, the storage panel may be positioned at any number of different positions within a particular range between a stored position in which the panel is positioned within the safe and one or more exterior positions in which the panel is positioned wholly or partially outside of the safe.

In some embodiments, the means for pivotably moving an internal safe storage panel from an interior portion of a safe to an exterior portion of a safe may be automated. For example, in some embodiments, upon opening the door of a safe, the storage panel may be configured to automatically move from an interior storage position to an exterior position in which the panel is positioned wholly or partially outside of the safe to allow for easier access to the weapons or other items stored within or on the storage panel. In some such embodiments, a sensor may be positioned on or adjacent to the safe door such that opening the door triggers the sensor, which actuates the mechanism to move the storage panel between two positions. In other embodiments, a control panel or other such control means may be provided to allow for manual actuation of the storage panel as desired.

In some embodiments, a pin, magnet, hold-in, or other locking mechanism may be used to temporarily lock or hold the storage panel within position, either inside or outside of the safe. For example, after swinging storage panel 510 to a position outside of safe 500, a pin may be placed in joint 540 and/or joint 542 to lock storage panel 510 in place. These pins may then be removed as desired in order to allow for rotating storage panel 510 to a storage position within safe 500.

Figure 6:
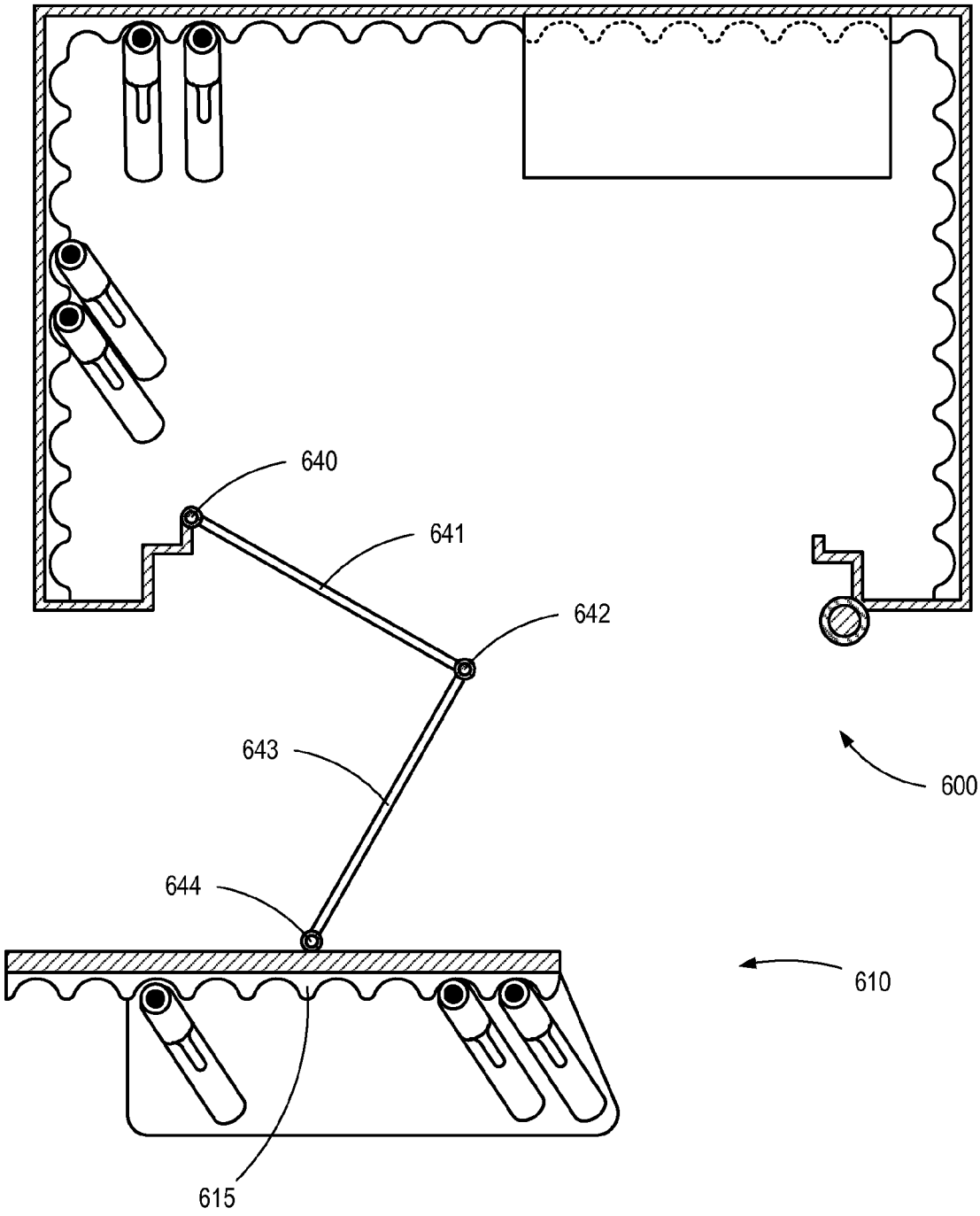
FIG. 6 is a cross-sectional view of a safe comprising another alternative interior storage panel.

FIG. 6 depicts a safe 600 comprising an alternative embodiment of a storage panel 610. Storage panel 610 comprises a gun rack 615, which may be similar to those previously described. However, safe 600 comprises an alternative means for pivotably moving an internal safe storage panel 610 from an interior portion of safe 600 to an exterior portion of safe 600. More particularly, safe 600 comprises two link arms, namely, link arms 641 and 643, which are interconnected by three pivots joints 640, 642, and 644. By providing additional pivot joints and link arms, the embodiment of FIG. 6 provides additional flexibility for the positions in which panel 610 can be positioned, both within safe 600 and outside of safe 600.

Figure 7:
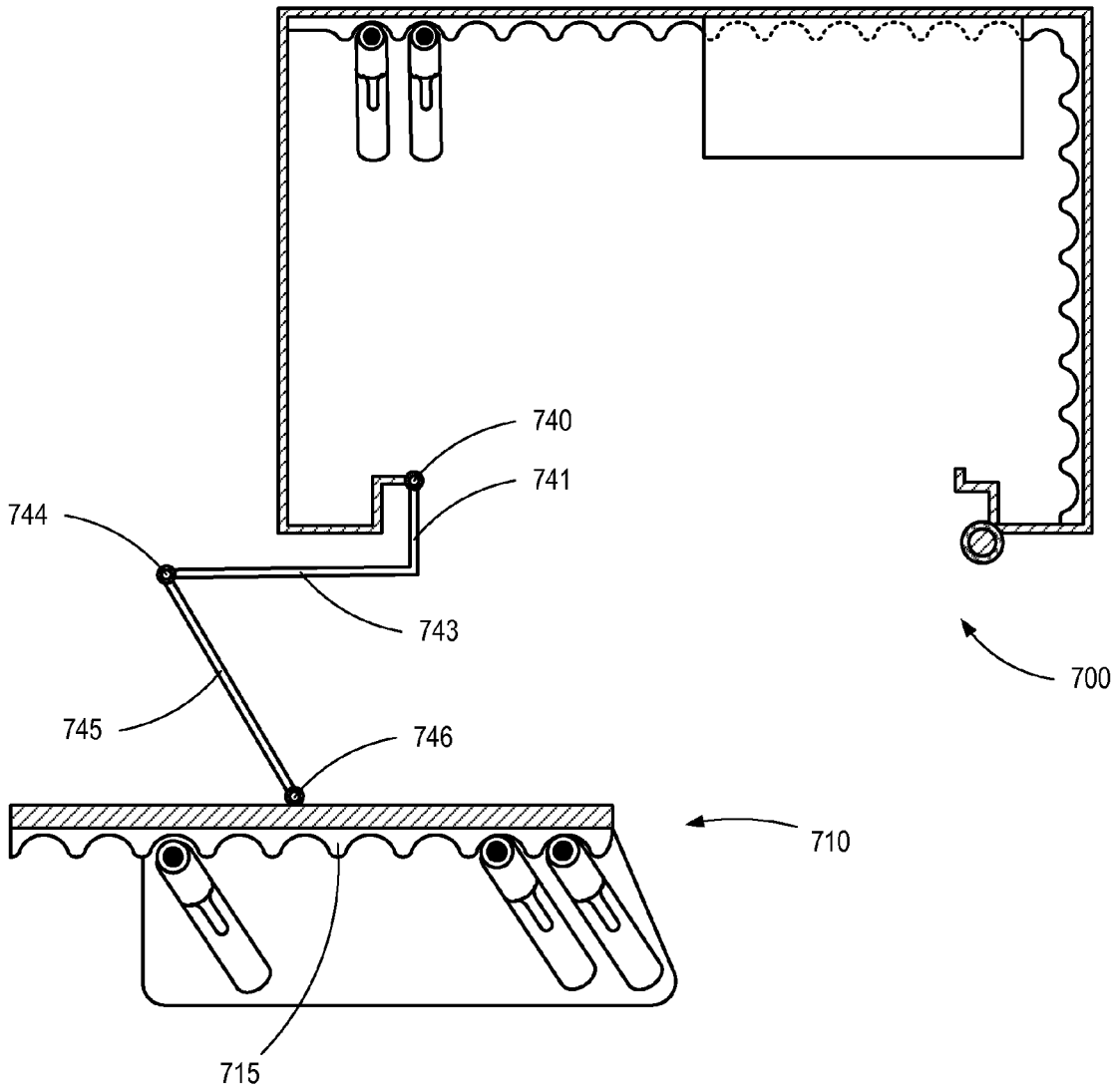
FIG. 7 is a cross-sectional view of another safe comprising still another alternative interior storage panel.

FIG. 7 depicts a safe 700 comprising another embodiment of a storage panel 710 comprising an alternative means for pivotably moving an internal safe storage panel from an interior portion of a safe to an exterior portion of a safe, and further comprising a gun rack 715. The means for pivotably moving internal safe storage panel 710 from an interior portion of safe 700 to an exterior portion of safe 700 comprises three link arms, namely, link arms 741, 743, and 745, which are interconnected by three pivots joints 740, 744, and 746. As shown in the figure, link arms 741 and 743 are not interconnected by a joint. This may provide for a more rigid positioning within safe 700 to accommodate a particular internal space design, while still providing some flexibility in positioning storage panel 710 outside of safe 700.

Figure 8:
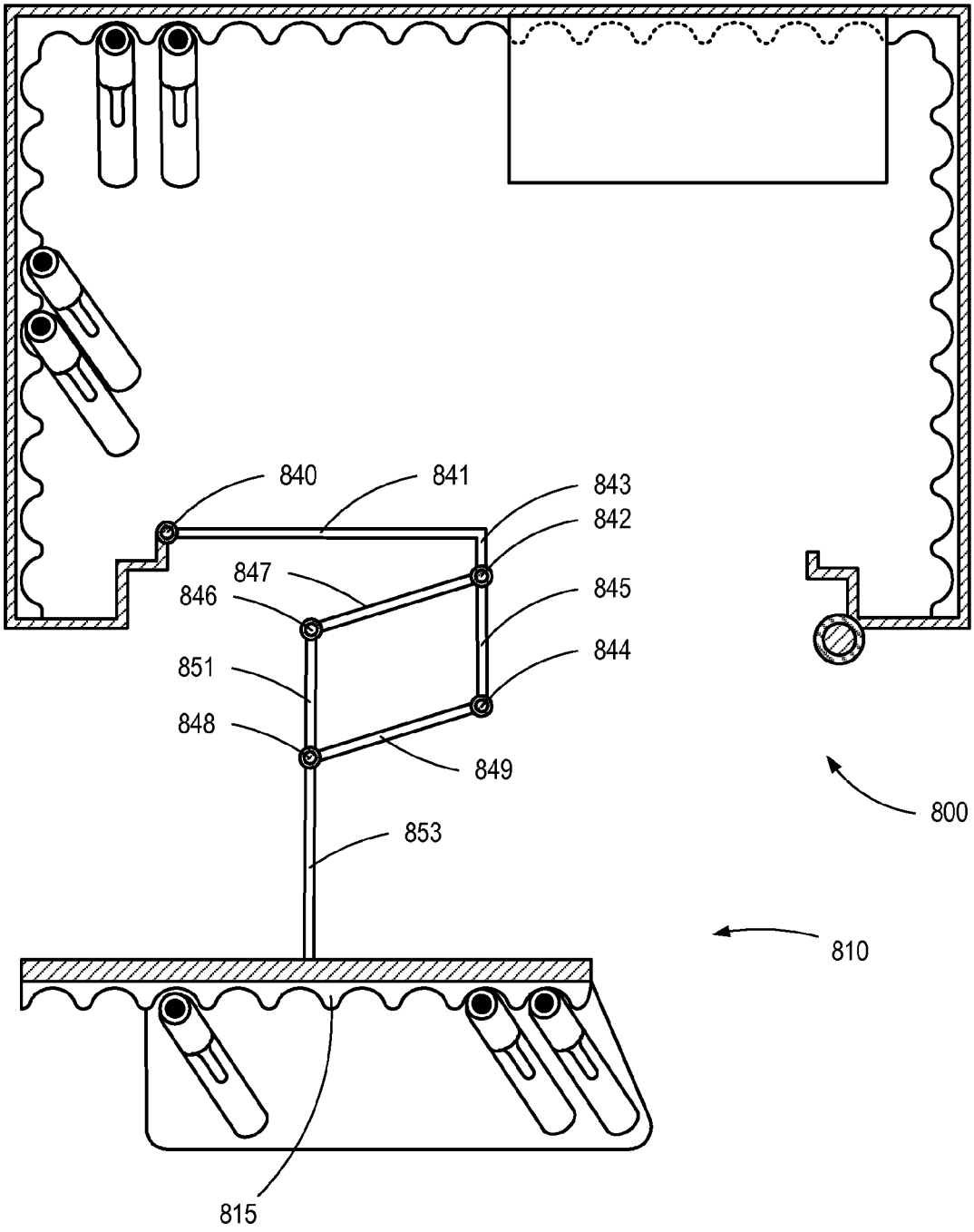
FIG. 8 is a cross-sectional view of a safe comprising yet another alternative interior storage panel.

FIG. 8 depicts a safe 800 comprising an embodiment of a storage panel 810 comprising still another alternative means for pivotably moving an internal safe storage panel from an interior portion of a safe to an exterior portion of a safe, and further comprising a gun rack 815. The means for pivotably moving internal safe storage panel 810 from an interior portion of safe 800 to an exterior portion of safe 800 comprises seven link arms, namely, link arms 841, 843, 845, 847, 849, 851, and 853, which are interconnected by five pivot joints 840, 842, 844, 846, and 848. As shown in the figure, link arms 841 and 843 are not interconnected by a joint. However, each of the other link arms is coupled to an adjacent link arm with a joint. In addition, the structure made up of link arms 845, 847, 849, and 851, and joints 842, 844, 846, and 848, may be used to provide additional stability and strength to allow for accommodation of a panel 810 and/or guns or other items stored thereon having a greater overall weight. In some embodiments, the lengths of the link arms and spacing of the joints in this structure may be configured such that the structure can collapse to at least approximately a linear shape.

Figure 9:
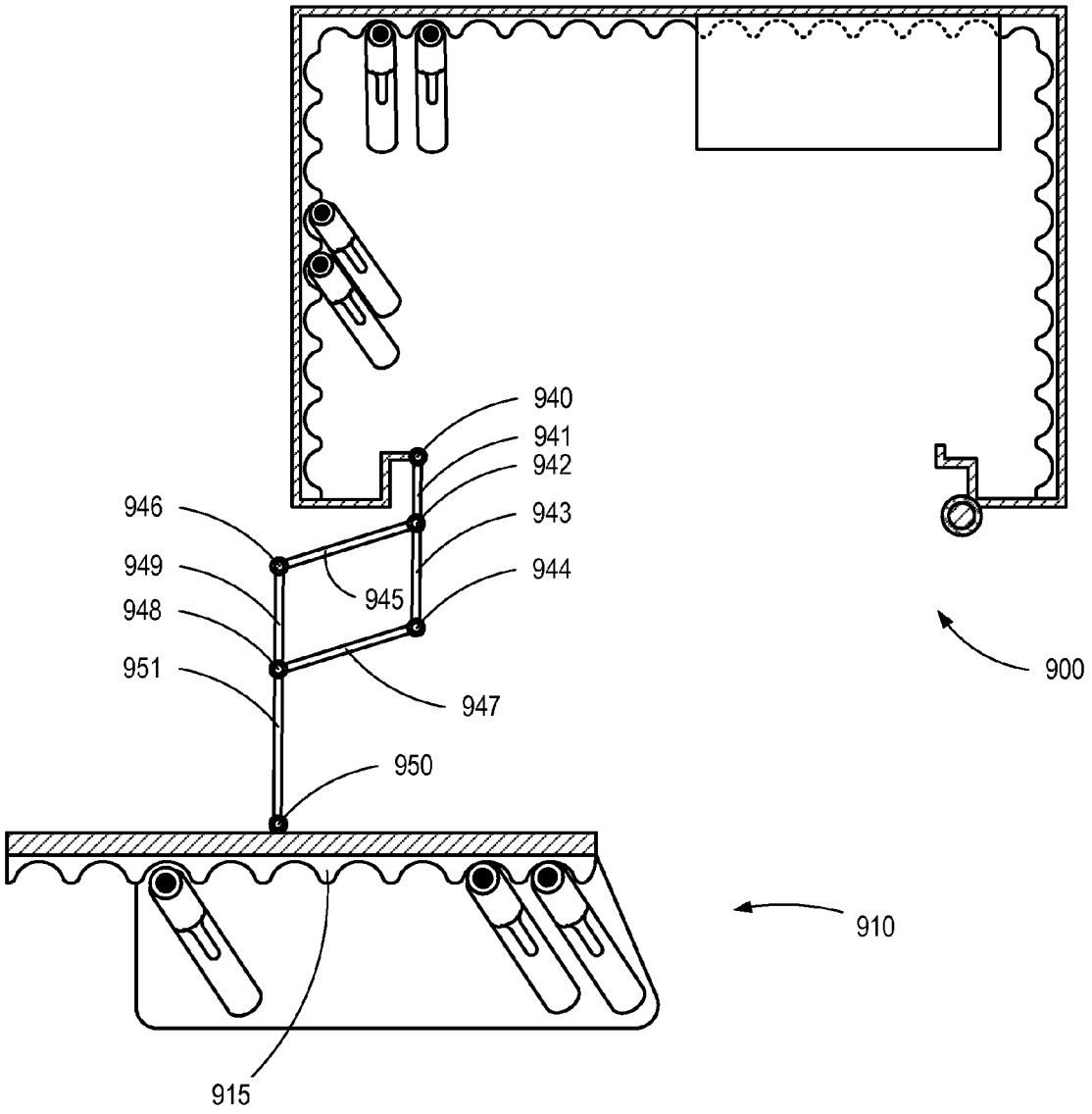
FIG. 9 is a cross-sectional view of a safe comprising another embodiment of an interior storage panel.

FIG. 9 depicts yet another alternative embodiment of a safe 900 comprising a storage panel 910 having a gun rack 915. Safe 900 comprises means for pivotably moving internal safe storage panel 910 from an interior portion of safe 900 to an exterior portion of safe 900. This pivotable moving means comprises six link arms, namely, link arms 941, 943, 945, 947, 949, and 951, which are interconnected by six pivots joints 940, 942, 944, 946, 948, and 950. Like storage panel 810, storage panel 910 comprises a collapsible structure comprising four link arms 943, 945, 947, and 949 and four joints 942, 944, 946, and 948, which may be used to provide additional stability and strength.

However, unlike storage panel 810 and its accompanying means for pivotably moving an internal safe storage panel from an interior portion of a safe to an exterior portion of a safe, storage panel 910 and its accompanying means for pivotably moving an internal safe storage panel from an interior portion of a safe to an exterior portion of a safe are provided with greater positioning flexibility. This is because a joint 950 is positioned immediately adjacent to storage panel 910, and because the number of joints is greater than the number of link arms. As such, storage panel 910 is configured to be positionable in a greater number of positions/configurations, both within and outside of safe 900.

Figure 10:
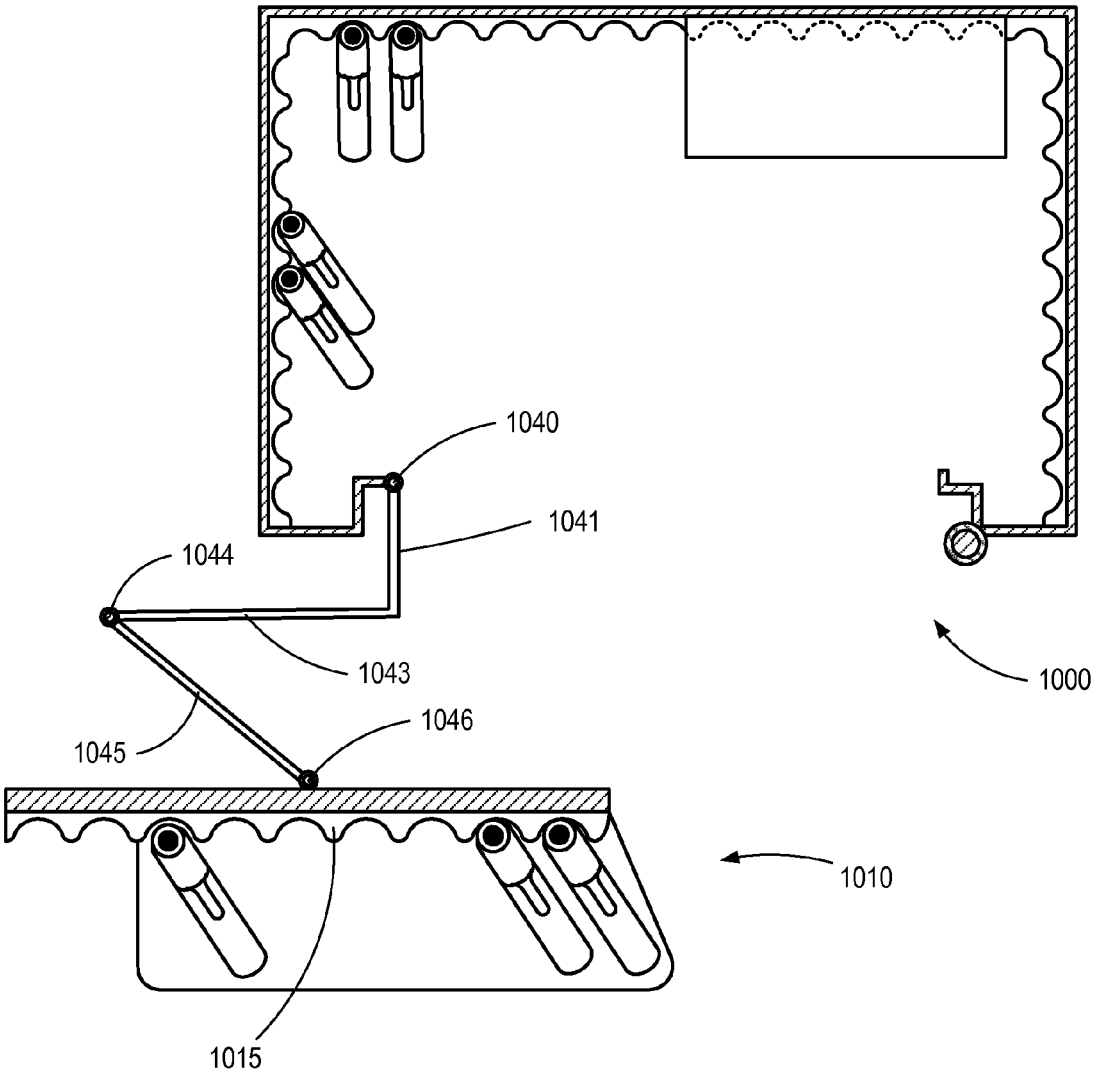
FIG. 10 is a cross-sectional view of a safe comprising still another embodiment of an interior storage panel.

FIG. 10 depicts yet another alternative embodiment of a safe 1000 comprising storage panel 1010, which comprises gun rack 1015. Like the means for pivotably moving an internal safe storage panel from an interior portion of a safe to an exterior portion of a safe storage panel associated with storage panel 710, the means for pivotably moving internal safe storage panel 1010 from an interior portion of safe 1000 to an exterior portion of safe 1000 comprises three link arms, namely, link arms 1041, 1043, and 1045, which are interconnected by three pivots joints 1040, 1044, and 1046. As shown in the figure, link arms 1041 and 1043 are not interconnected by a joint. However, link arm 1043 comprises an adjustable link arm in which the length of the link arm 1043 may be adjusted to further provide for adjustment of the position of storage panel 1010 within and/or outside of safe 1000. In some embodiments, adjustable link arm 1043 may comprise two telescoping portions, one of which may be slidably received in the other to provide for such adjustment. Alternatively, link arm 1043, or another similar link member, may be made adjustable by providing overlapping plates with slots configured to be slidably received in the slots.

Figure 11:
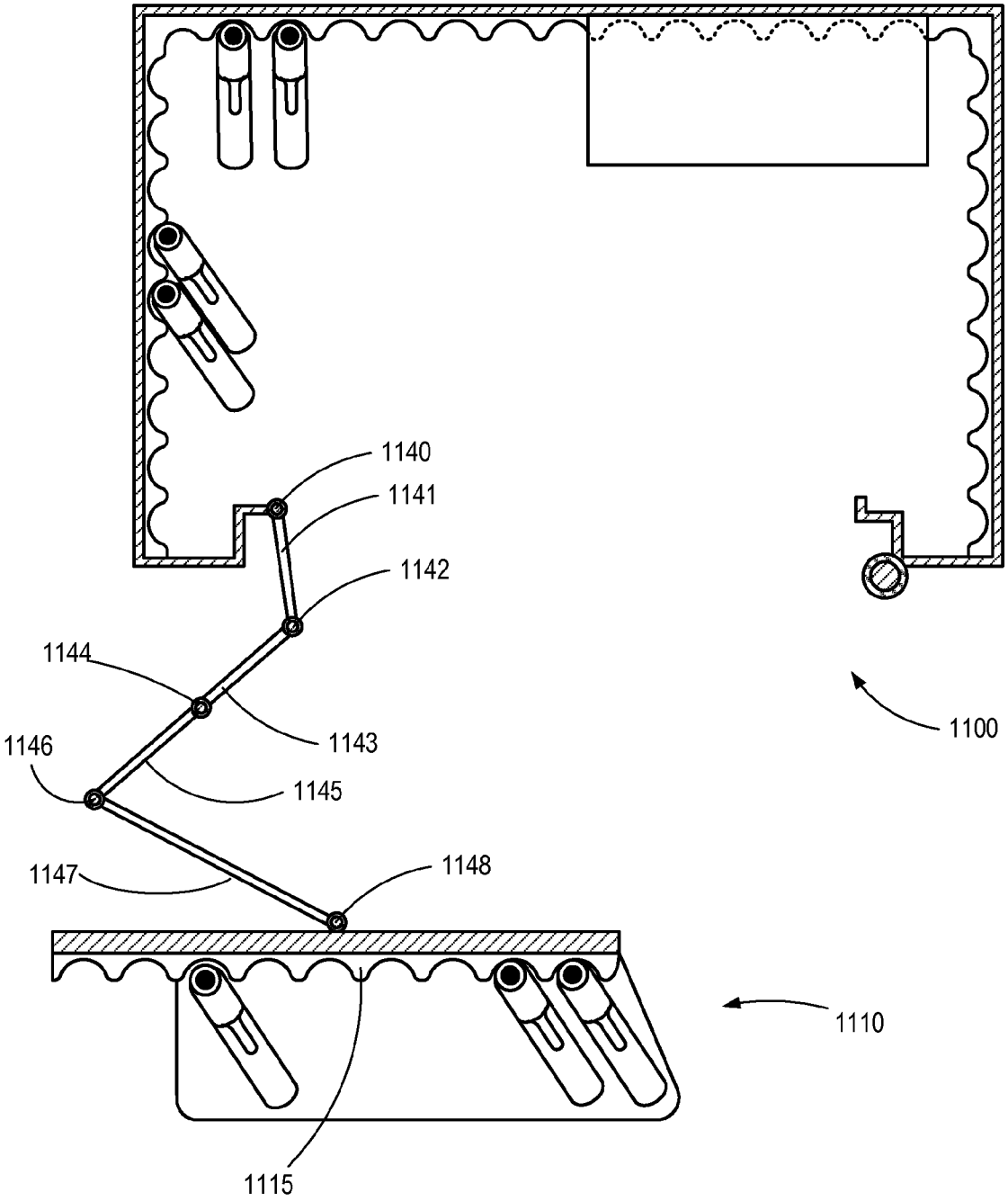
FIG. 11 is a cross-sectional view of a safe comprising yet another embodiment of an interior storage panel.

FIG. 11 depicts yet another alternative embodiment of a safe 1100. Safe 1100 comprises storage panel 1110, which comprises a gun rack 1115 and further comprises a means for pivotably moving internal safe storage panel 1110 from an interior portion of safe 1100 to an exterior portion of safe 1100. The pivotably moving means of storage panel 1110 comprises four link arms, namely, link arms 1141, 1143, 1145, and 1147, which are interconnected by five pivot joints 1140, 1142, 1144, 1146, and 1148. However, one of the pivot joints—namely, pivot joint 1144—is configured to pivot in a direction and/or along an axis that differs from that of the other pivot joints. In some embodiments, this pivot joint may be at least substantially perpendicular to that of the other pivot joints. For example, pivot joint 1144 may be configured to pivot in a vertical axis and the other pivot joints may be configured to pivot in horizontal axes. Of course, any combination of vertical and/or horizontal pivot joints may be used, as desired. Or, as mentioned above, in some embodiments, one or more pivot joints may be configured to pivot about more than one axis.

Figure 12:
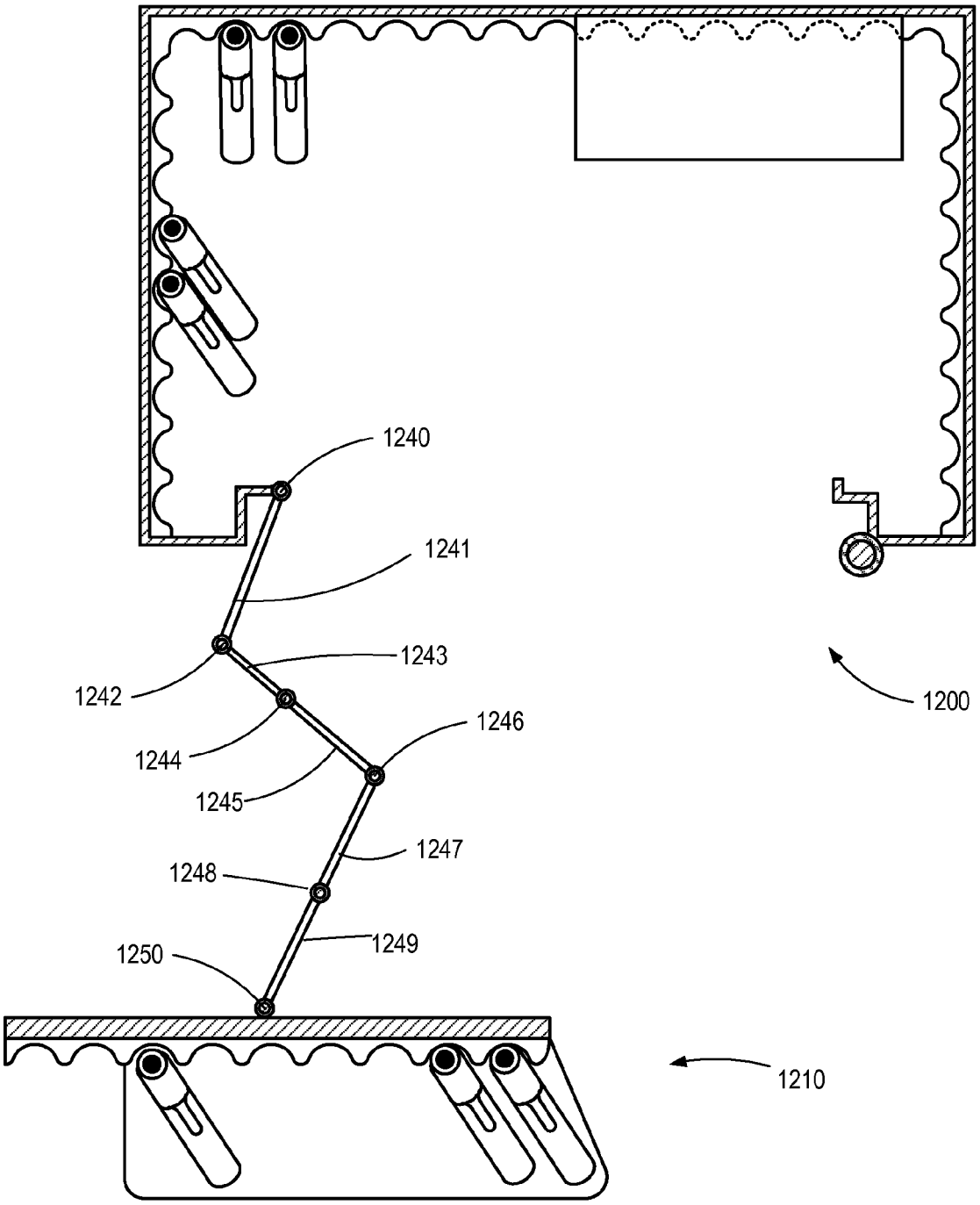
FIG. 12 is a cross-sectional view of another safe comprising an alternative interior storage panel.

For example, in safe 1200 of FIG. 12, pivot joints 1244 and 1248 may be configured to pivot along one or more axes that differ from the one or more axes along which one or more of the other pivot joints 1240, 1242, 1246, and 1250 are configured to pivot. This may allow for still greater flexibility in maneuvering and/or positioning of storage panel 1210. As with several of the other embodiments previously described, a number of link arms 1241, 1243, 1245, 1247, and 1249 may be used to interconnect the various pivot joints.

Figure 13:
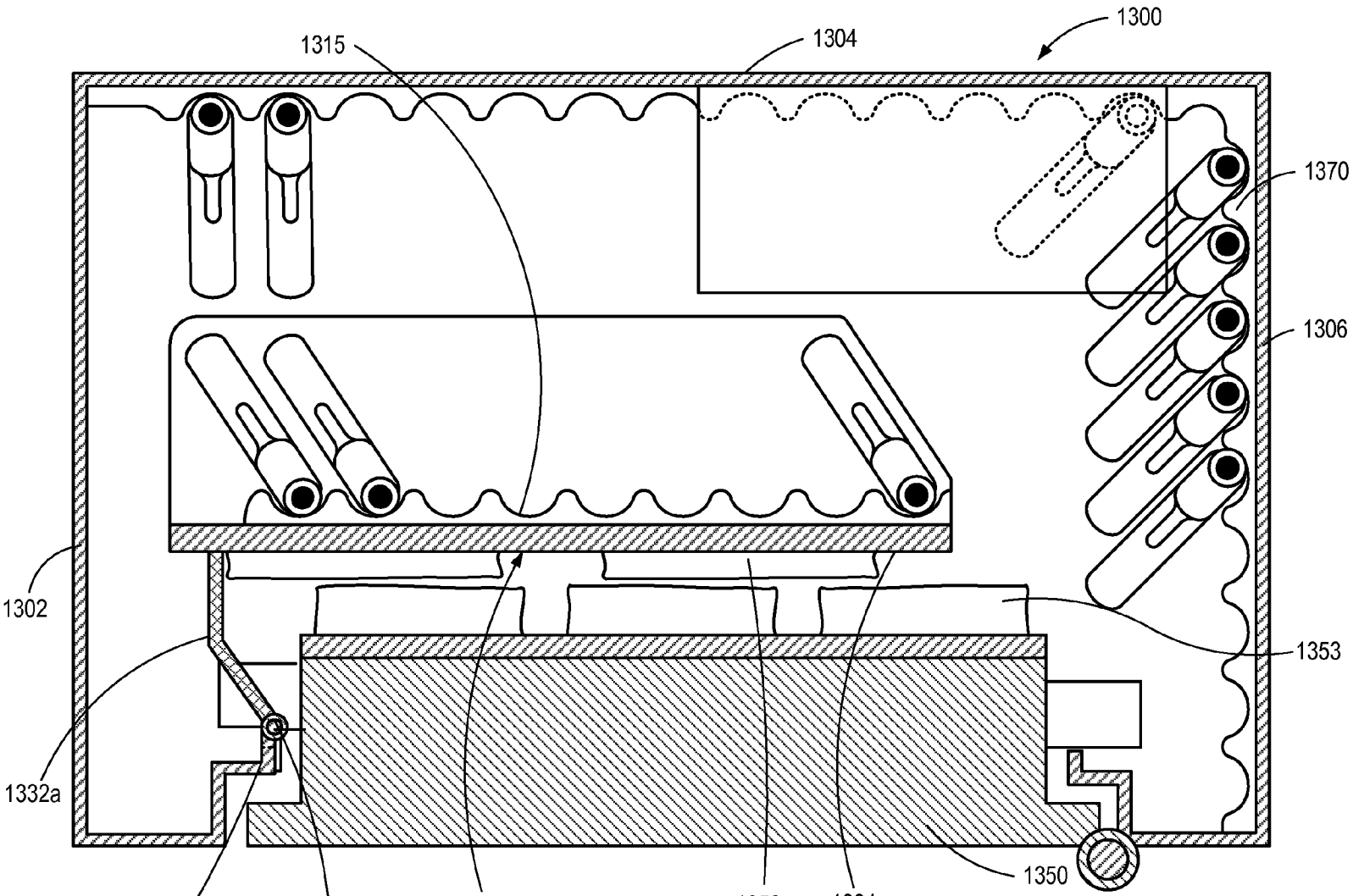
FIG. 13 is a cross-sectional view depicting an interior of a gun safe comprising an interior storage panel according to another embodiment.

FIG. 13 is a cross-sectional view of another embodiment of a gun safe 1300. Safe 1300 comprises a storage panel 1310 that is shown positioned within an internal space of safe 1300 when safe door 1350 is closed. Panel 1310 comprises a panel coupling member **1332*a* that is configured to couple panel 1310 to an interior portion of safe 1300. In the depicted embodiment, panel coupling member 1332*a* is configured to couple panel 1310 to door frame 1352 via hinge 1330. Hinge 1330 may allow for panel 1310 to swing open after door 1350 has been opened, as previously described. Hinge 1330** is another example of a means for pivotably moving an internal safe storage panel from an interior portion of a safe to an exterior portion of a safe.

However, other embodiments are contemplated in which panel 1310 may be coupled to other portions of the interior of safe 1300, such as to a floor, sidewall surface, such as sidewall 1302, sidewall 1306, or rear wall 1304, or to a ceiling wall, for example.

Panel coupling member **1332*a* may be welded or otherwise attached to panel 1310 with one or more fasteners, such as screws, rivets, bolts, and the like. Alternatively, panel coupling member 1332*a* may be integrally formed with panel 1310. As shown in FIG. 13, panel coupling member 1332*a* is configured such that, in a closed configuration, panel 1310 extends at least substantially parallel to rear wall 1304**.

Panel 1310 also comprises a gun storage rack 1315, which may be used to hold or otherwise store one or more guns. Other similar storage mechanisms may be provided in other areas of safe 1300. For example, a rack 1370 may be positioned around one or more interior surfaces of safe 1300. In the embodiment depicted in FIG. 13, rack 1370 extends around the interior surface of rear wall 1304 and sidewall 1306. Also, it can be seen that the portion of rack 1370 that extends along sidewall 1306 is configured to store firearms in a slanted configuration relative to the sidewall 1306, whereas the portion of rack 1370 that extends along rear wall 1304 is configured to store firearms in at least a substantially perpendicular direction relative to rear wall 1304, which may further assist in avoiding contact between panel 1310 and/or one or more items stored thereon or otherwise facilitate maximizing space within safe 1300.

One or more means for storing firearms and/or firearms accessories, such as ammunition, scopes, sights, gun cleaning accessories, and the like, may be positioned within or along one or more portions/elements of safe 1300. For example, an interior surface of safe door 1350 may comprise one or more pockets 1353, as previously described. One or more pockets or other storage means may also, or alternatively, be positioned on one or both surfaces of panel 1310 in order to further maximize use of available storage space.

For example, a front surface (opposite from the surface on which rack 1315 is positioned) of panel 1310 also may comprise one or more pockets 1353*a*. In this manner, certain items may be immediately accessible upon opening door 1350. For example, a safe owner may wish to store important papers or documents, such as passports, titles, insurance records, etc., in one or more pockets 1353*a*. In order to protect items in pockets 1353 and/or 1353*a*, in some embodiments, the rear surface of panel 1310 (on which pockets 1353*a* are mounted) and/or the rear surface of door 1350 (on which pockets 1353 are mounted) may comprise one or more layer of cushioning material.

Figure 14:
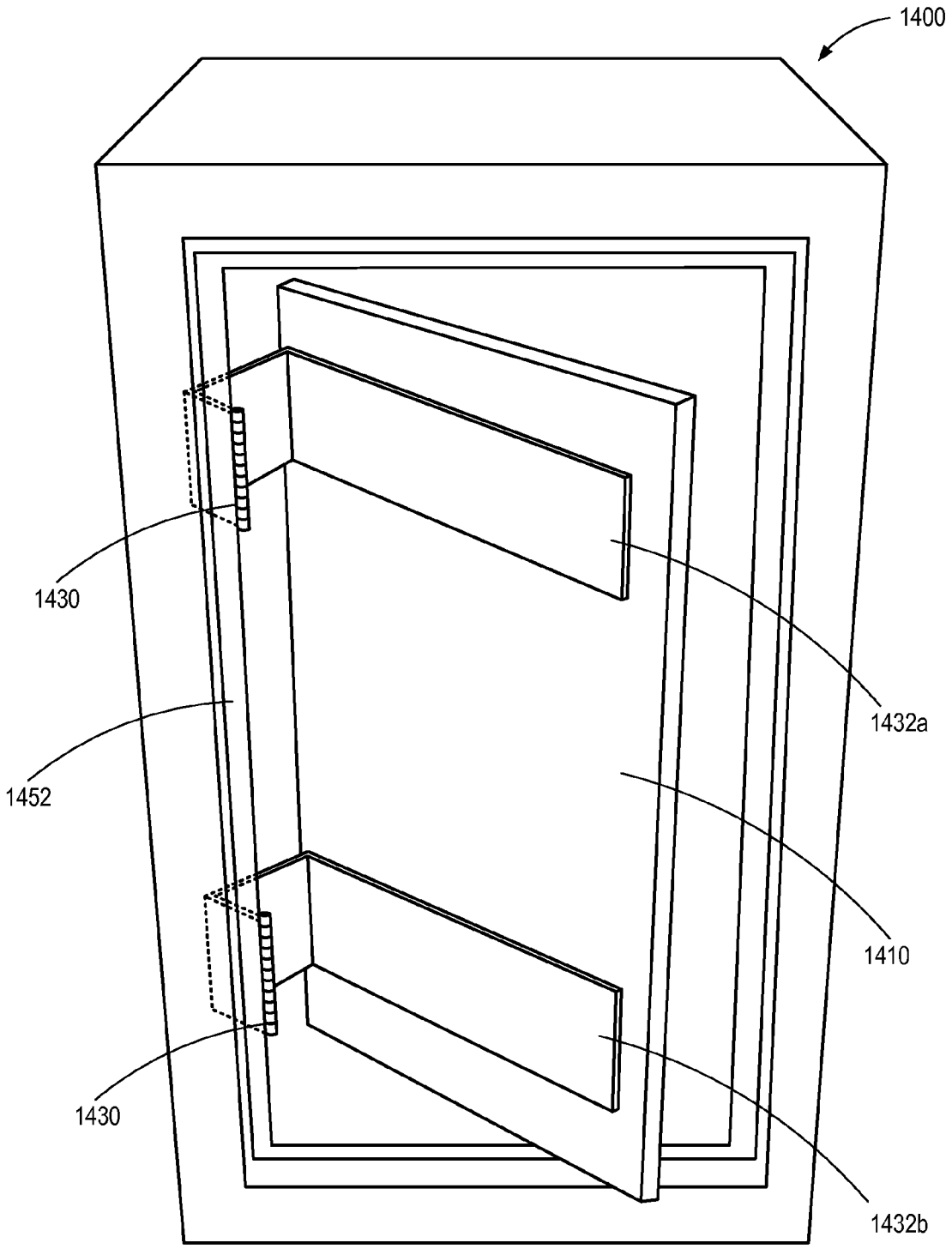
FIG. 14 is a perspective view depicting a gun safe comprising an interior storage panel according to yet another embodiment.

FIG. 14 is a perspective view depicting another embodiment of a gun safe 1400. Gun safe 1400 comprises an interior storage panel 1410 that is coupled to door frame 1452 of safe 1400 by way of two U-shaped panel coupling members 1432*a* and 1432*b*. More particularly, panel coupling members 1432*a* and 1432*b* are coupled to panel 1410 and are further coupled to door frame 1452 by hinges 1430. Panel coupling members 1432*a* and 1432*b* may be coupled with panel 1410 by any number of ways. For example, in embodiments in which storage panel 1410 and coupling members 1432*a* and 1432*b* are made up of a metal, they may be welded together. Alternatively, they may be coupled with one or more fasteners, such as screws, bolts, rivets, etc., or some sort of adhesive.

Of course, a variety of alternative embodiments are contemplated. For example, in some embodiments, only a single panel coupling member may be used. In some such embodiments, the panel coupling member may be coupled with the storage panel at a central location, rather than on upper and lower portions of the panel member as depicted in FIG. 14. In addition, although U-shaped panel coupling members 1432*a* and 1432*b* both comprise shapes in which one leg of the "U" shape is longer than the other, this need not be the case in all embodiments. In other embodiments, the coupling member(s) need not be U-shaped. For example, the panel coupling member(s) may be curved. It should also be understood that, although a door is not shown on safe 1400 in FIG. 14 for ease of illustration, it is contemplated that safe 1400 would comprise such a door.

Figure 15:
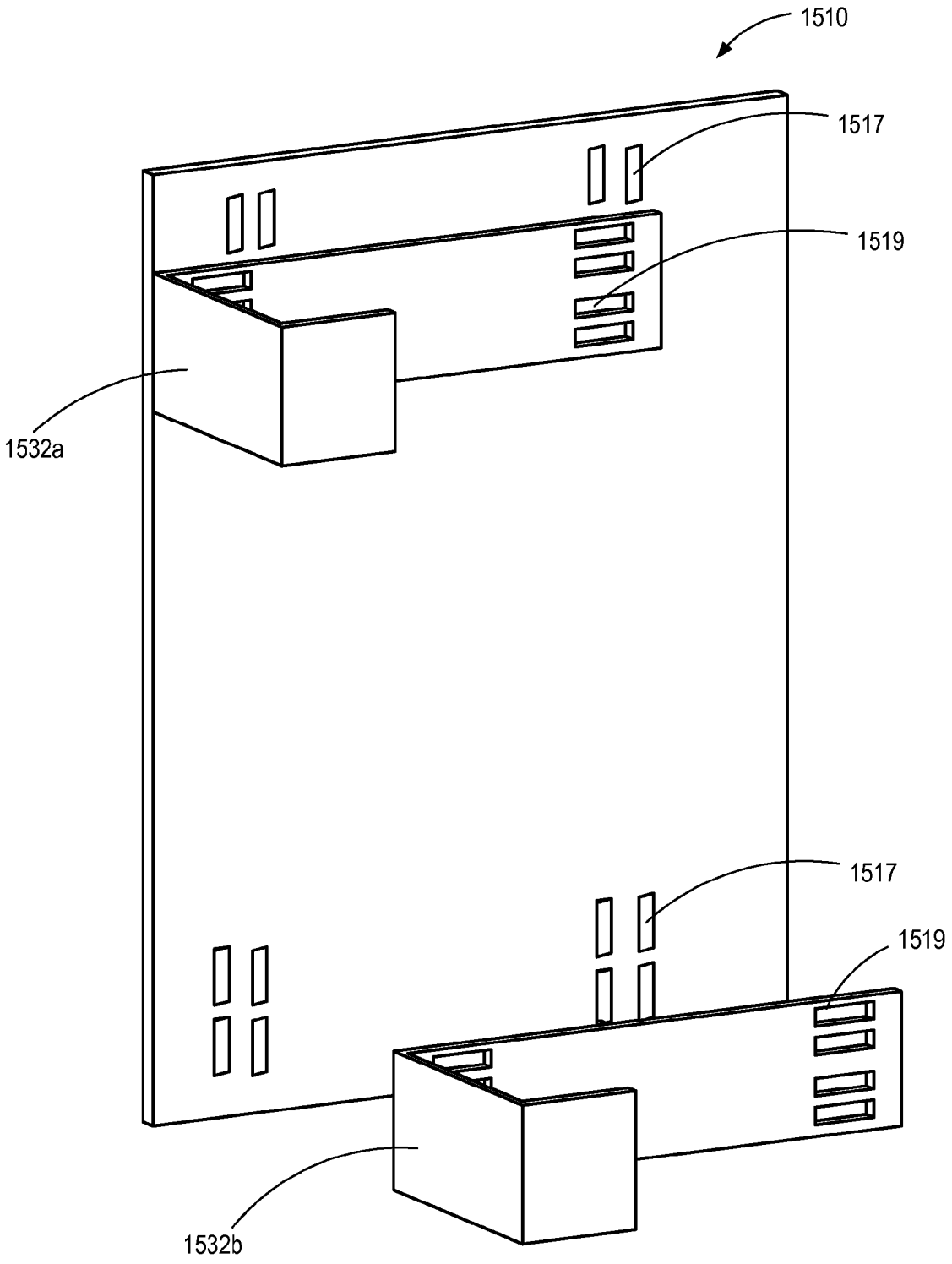
FIG. 15 is a perspective view depicting certain components of an embodiment of an interior storage panel.

FIG. 15 is a perspective view of an alternative embodiment of interior storage panel 1510 along with panel coupling members 1532*a* and 1532*b*. Storage panel 1510 comprises a series of spaced slots 1517 and panel coupling members 1532*a* and 1532*b* each comprise a corresponding series of spaced slots 1519. Slots 1517 and 1519 may be used to facilitate adjustably coupling panel coupling members 1532*a* and 1532*b* with panel 1510. This may be useful, for example, to allow for use of a storage panel 1510 with a single size/shape to be used with safes having different sizes. It is contemplated that, upon aligning one or more slots 1517 with one or more slots 1519, one or more fasteners would be inserted through slots 1517 and 1519 to affix the panel coupling member(s) to the interior storage panel. It can also be seen in FIG. 15 that slots 1517 are vertical slots and slots 1519 are horizontal slots. However, in other embodiments, the direction of these slots may be reversed. It should also be understood that the shapes, sizes, locations, and number of slots may be varied as desired.

In some embodiments, the interior storage panel may be removable from a panel coupling member. For example, one or more screws, buttons, or other protruding members may be positioned on a rear surface of the storage panel, which may be configured to be received within one or more slots having a widened receiving area formed on one or more of the panel coupling members. In this manner, the panel may be lifted and removed from the panel coupling member(s) and repositioned as desired. In some embodiments, the interior storage panel may be rotatably adjustable relative to the panel coupling members and/or safe door. In this manner, storage panels may be used that are taller and/or wider than the safe door opening but that may be removed from the safe by, for example, positioning the storage panel in a diagonal direction relative to the door opening.

Figure 16:
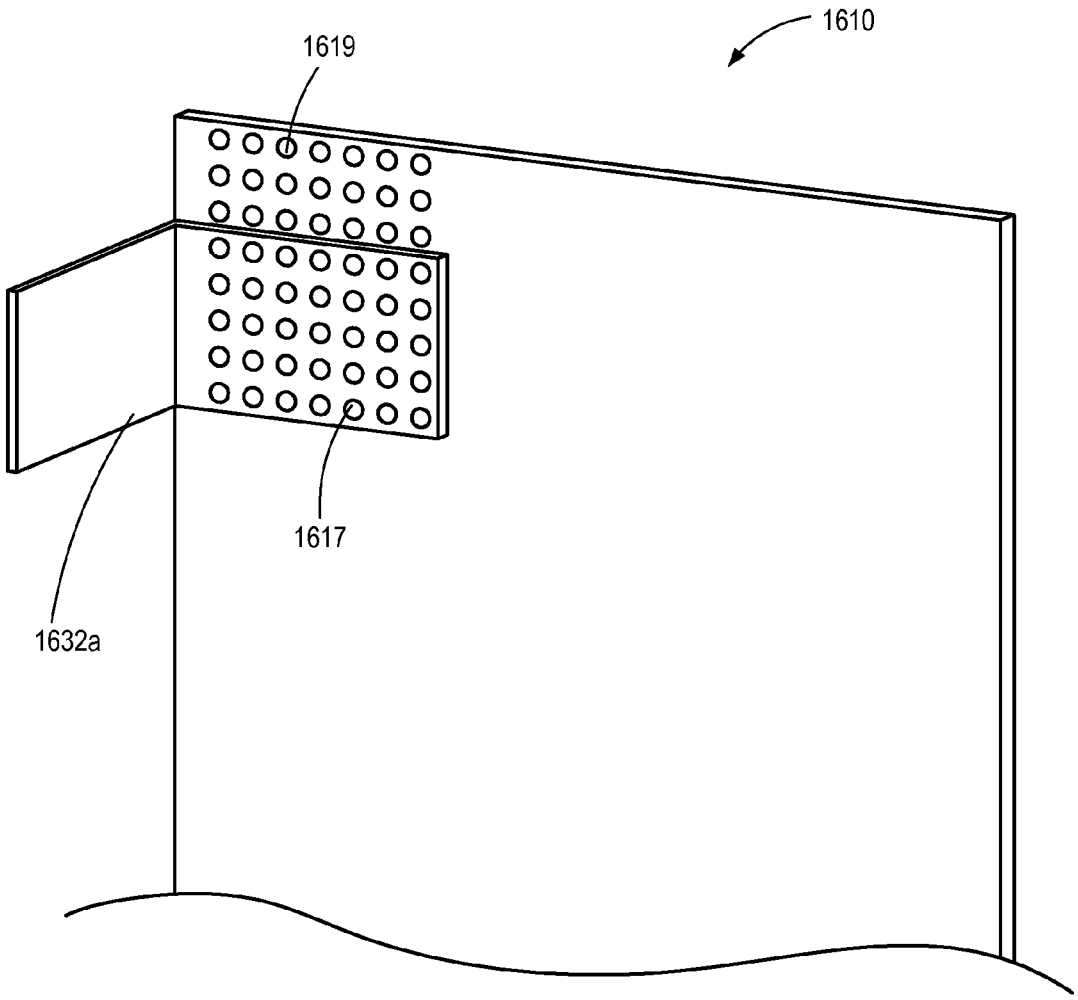
FIG. 16 is a partial, perspective view depicting certain components of another embodiment of an interior storage panel.

FIG. 16 is a partial, perspective view depicting certain components of another embodiment of an interior storage panel 1610 and accompanying panel coupling member 1632*a*. Panel 1610 comprises a plurality of fastener openings 1619 arranged in a grid. Similarly, panel coupling member 1632*a* also comprises a plurality of fastener openings 1617 arranged in a grid. As such, the positioning of panel coupling member 1632*a* relative to panel 1610 may be adjusted by aligning one or more openings 1617 with one or more openings 1619 and fastening a fastener therethrough. Of course, one or more other grids may be used and the spacing, size, number, and positioning of the fastener openings on one or both of panel 1610 and panel coupling member 1632*a* may vary as desired.

Figure 17:
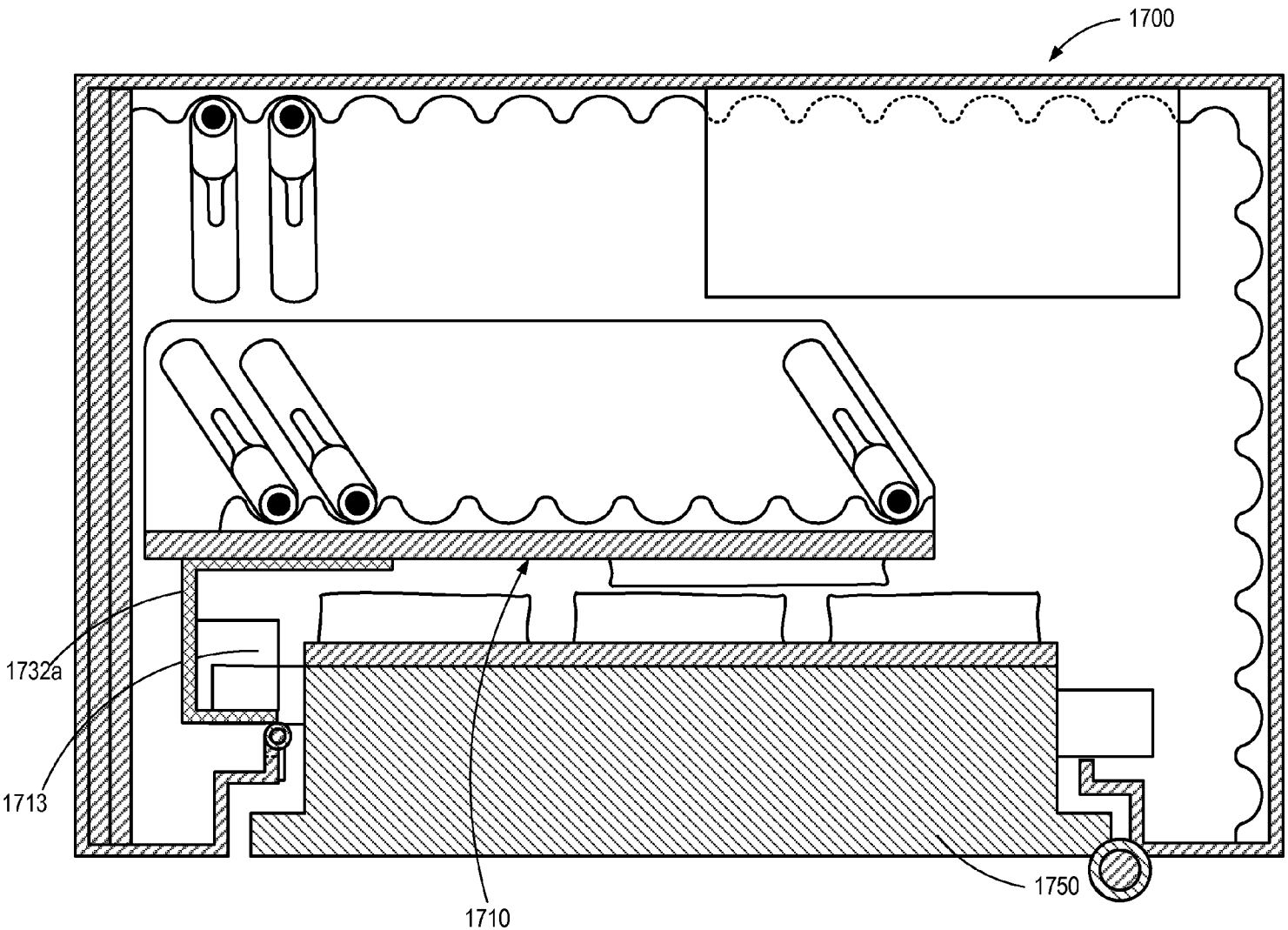
FIG. 17 is a cross-sectional view depicting an interior of a gun safe comprising an interior storage panel according to yet another embodiment.

FIG. 17 is a cross-sectional view depicting yet another embodiment of a safe 1700. Safe 1700 comprises a U-shaped panel coupling member 1732*a* that is coupled with an interior storage panel 1710. Safe 1700 is depicted in a closed position with safe door 1750 closed. Safe 1700 also comprises a shelf 1713 positioned in between opposing legs of U-shaped panel coupling member 1732*a*. Any number of shelves/racks, etc., may be positioned in this location in order to further maximize usable storage space within safe 1700.

Figure 18:
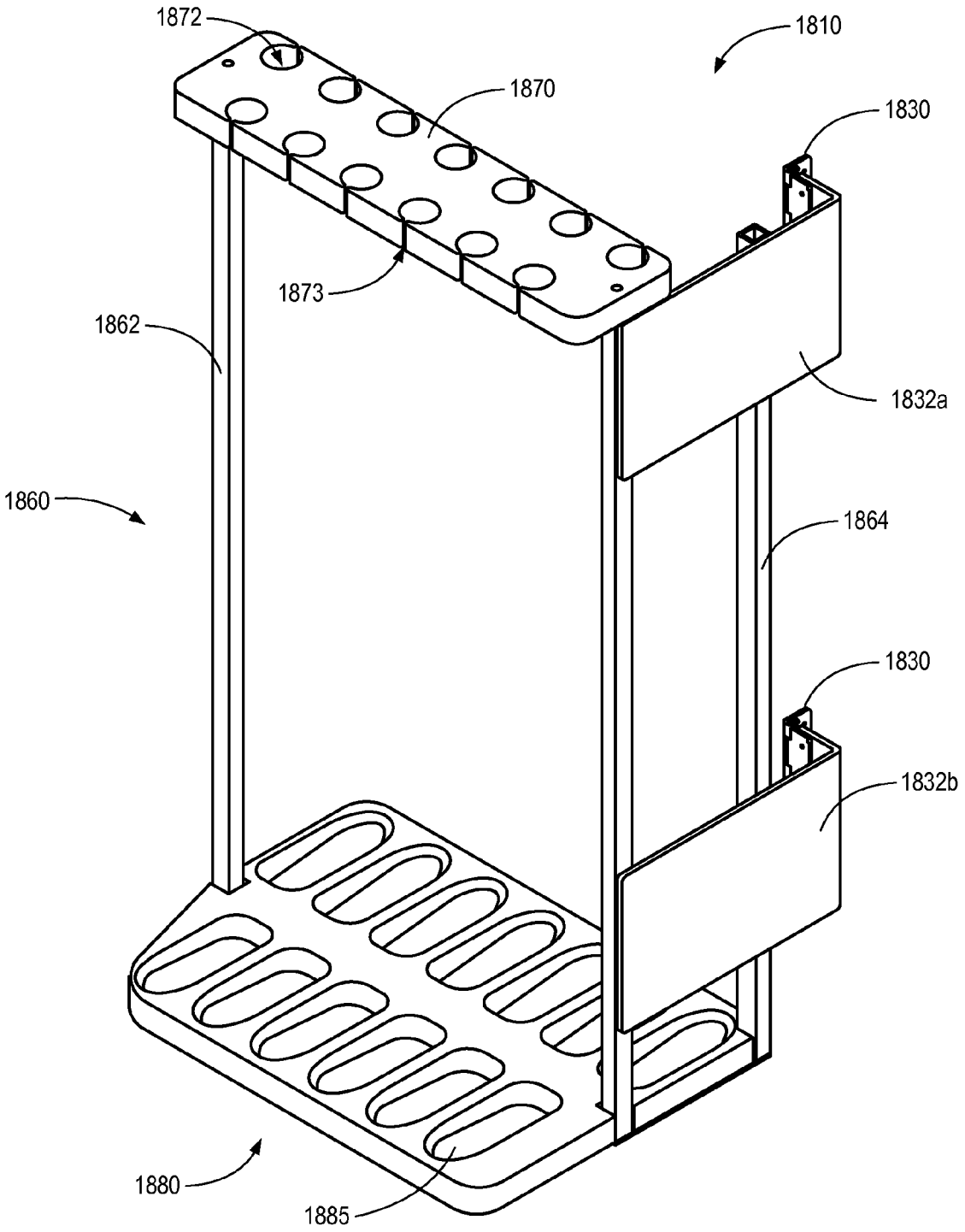
FIG. 18 is a perspective view of still another embodiment of an interior storage panel configured for use within a safe.

FIG. 18 depicts still another embodiment of an interior storage panel 1810 configured for use within a safe (not shown), such as a gun safe. Storage panel 1810 may be configured to be coupled with a door frame of such a safe by way of two panel coupling members 1832*a* and 1832*b*. Panel coupling members 1832*a* and 1832*b* comprise L-shaped coupling members. However, other coupling member shapes may be used, such as U-shaped coupling members, as described above, or other shapes as desired.

Panel coupling members 1832*a* and 1832*b* may be coupled to panel 1810 and to a safe (such as at the door frame, for example) by way of hinges 1830. As described above, this coupling may be accomplished by any means available to one of ordinary skill in the art, such as by way of welding, screws, bolts, rivets, adhesives, and/or other fasteners or techniques.

Figure 19:
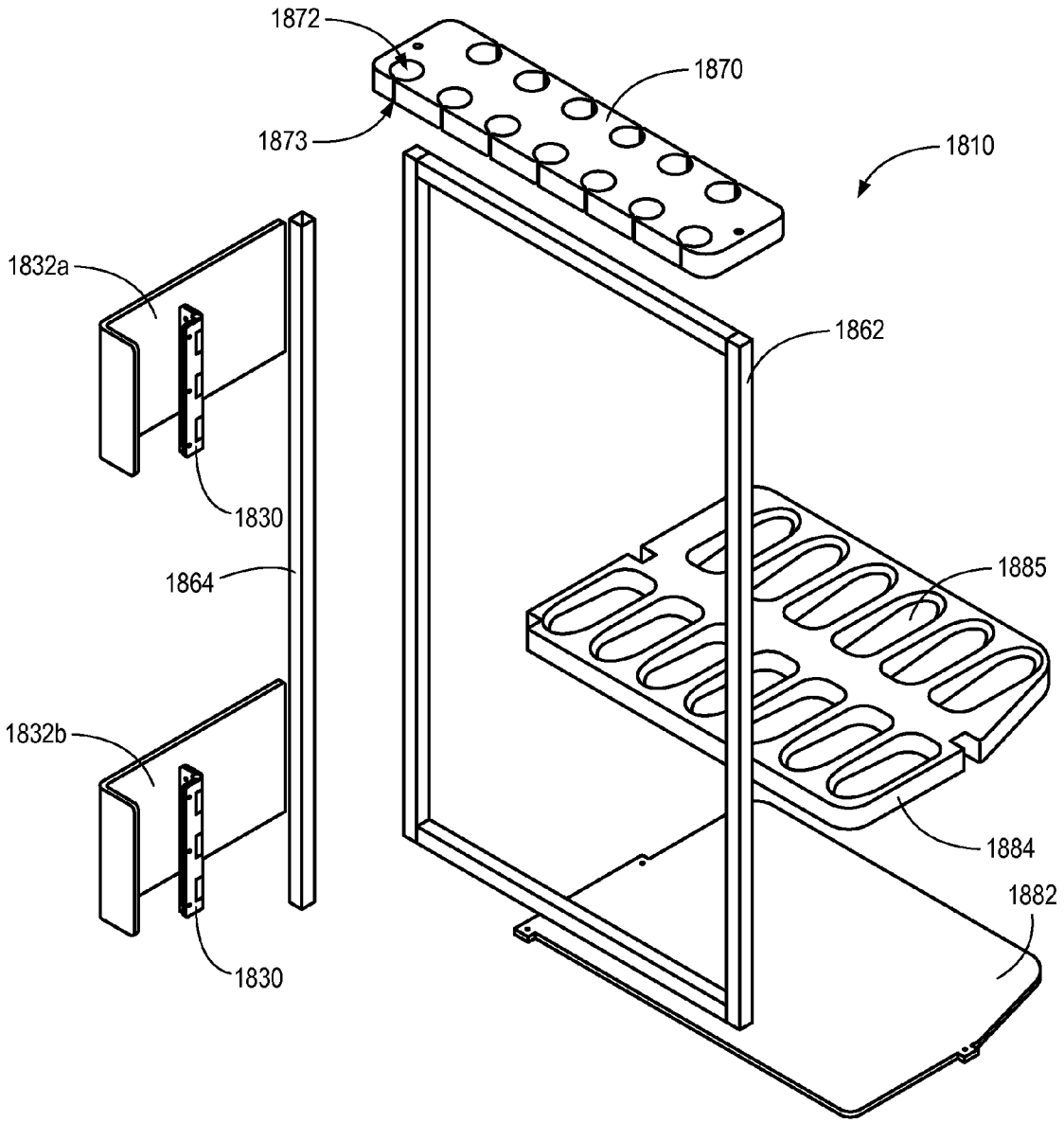
FIG. 19 is an exploded view of the interior storage panel of FIG. 18.

Interior storage panel 1810 differs from several of the particular embodiments discussed above in several respects. For example, instead of comprising a flat panel, storage panel 1810 comprises an open structure comprising a frame defined by a plurality of frame members. More particularly, this frame 1860 comprises a first frame member 1862 comprising a series of frame member elements defining a rectangular shape (as best seen in the exploded view of FIG. 19) and a second frame member 1864 comprising a bar or tube to provide structure to the frame 1860.

The use of arrays of slots, holes, or other adjustably coupling means, such as those described above in connection with FIGS. 15 and 16, may be provided in panel coupling member 1832*a*, panel coupling member 1832*b*, first frame member 1862, and/or second frame member 1864 to facilitate adjustably coupling panel coupling members 1832*a* and/or 1832*b* with storage panel 1860. This may be useful, for example, to allow for use of a storage panel 1810 with a single size/shape to be used with various safes having different sizes.

Some embodiments may also, or alternatively, comprise storage panels that are adjustable in height and/or width. For example, some embodiments may comprise storage panels having telescoping tubes or indexed bolt/screw holes or the like, to accommodate different sizes of safes. Such features may also allow one or both of the upper and lower panel members, which are discussed below, to adjust a barrel and/or buttstock rest to be adjusted to match a desired barrel length.

Of course, other embodiments are contemplated having differing numbers frame members and/or different types of frame structures. For example, instead of comprising a rectangular shape, first frame member 1862 may be defined by two separate frame member elements each extending on an opposite end of the storage panel 1810. Similarly, in some embodiments, additional frame members or other similar elements may be used to define frame 1860. Frame members 1862 and 1864 may be coupled to panel coupling members 1832*a* and 1832*b* by, for example, welding, adhesives, or any of the various fasteners referenced above. Frame members 1862 and 1864 are preferably made up of a rigid and strong material, such as steel or certain other metals, wood, certain strong plastics, and the like.

Upper and/or lower panel members may be used to further define storage panel 1810. For example, in the embodiment depicted in FIGS. 18 and 19, an upper panel member 1870 and a lower panel member 1880 may be provided. Upper panel member 1870 comprises a series of openings 1872, which may be configured to receive the barrels of rifles or other firearms. Openings 1872 may comprise slots 1873, which may facilitate inserting such barrels into the respective openings 1872. In certain preferred embodiments, upper panel member 1870 may therefore be made up of a flexible and/or resiliently deformable/compressible material, such as foam, rubber, certain plastics, and the like. In alternative embodiments, upper panel member 1870 may comprise a plurality of depressions or grooves for receiving such barrels.

Lower panel member 1880 may comprise a plate 1882 and a cushion 1884 that may be coupled with (on top of) plate 1882. Cushion 1884 may comprise one or more grooves 1885, each of which may be configured to receive the buttstock of a rifle or other firearm. Thus, preferably the number of grooves 1885 is equal to the number of openings 1872. Cushion 1884 preferably comprises a soft and/or resiliently deformable/compressible material, such as foam, rubber, certain plastics, and the like.

In some embodiments, the upper and lower panel members described above may be reversed. In other words, the upper panel members may comprise grooves, slots, and/or openings for the firearm buttstocks and the lower panel members may comprise a cushion or pad, such as a hard rubber mat, with or without depressions, openings, and/or slots, to receive the firearm barrels.

Alternatively, some embodiments may comprise a storage panel having different subsets of the upper and lower panel members described above. For example, some embodiments may comprise a storage panel having one side configured to receive rifles or other firearms with barrels down and the other side of the panel with barrels up. Such configurations may allow the panel to be shallower front to back, thereby providing giving more space behind the panel when in the closed position, which may increase space and/or gun capacity. As yet another alternative, some embodiments may be configured such that the storage panel is configured to each receive adjacent firearm in an opposite configuration. In other words, a first slot/groove/space may be configured to receive a rifle with the barrel up, the second to receive an adjacent rifle with the barrel down, and so on.

In some embodiments, cushion 1884 may be larger than plate 1882 and/or positioned offset from plate 1882 such that at least a portion of cushion 1884 overhangs plate 1882, which may allow for an overhanging portion of cushion 1884 to act as a bumper or cushion for storage panel 1810 as it is rotated into and out of a safe.

Upper and lower panel members 1870 and 1880 may be coupled with frame members 1862 and 1864 by, for example, welding, adhesives, or any of the various fasteners referenced above. Alternatively, one or more of the frame members may be configured to be pressed onto or snap into a portion of the upper and/or lower panel members. Similarly, plate 1882 may be coupled with cushion 1884 by any means available to one of ordinary skill in the art, including adhesives, fasteners, and the like.

As with several embodiments discussed above, storage panel 1810 may be configured to be positioned in a closed position within a safe such that the safe door may be closed with storage panel 1810 entirely within the safe, and may be further configured to be rotate/swing/pivot storage panel 1810 to an open position at least partially outside of the safe. In some embodiments, storage panel 1810 may be configured to be rotated open such that panel 1810 is at least substantially positioned outside of the safe when the safe door has been opened and panel 1810 has been rotated open. In some such embodiments, storage panel 1810 may be configured to be rotated open such that panel 1810 is fully positioned outside of the safe when the safe door has been opened and panel 1810 has been rotated open.

In other words, with regard to storage panel 1810, panel coupling members 1832*a* and 1832*b* may be sized, dimensioned, and configured to allow for the entire panel 1810 and all of the items being stored therein, to be positioned outside of the safe when in the open position. This may be useful, particularly for certain large safes, to both improve ease of access to firearms or other items being stored on panel 1810, and also make more efficient use of the space within the safe.

In some embodiments, the storage panel may be configured to be repositioned between the storage and open positions by simply rotating the storage panel, rather than requiring a sequence of steps, such as pulling and/or sliding and then rotating, etc. Moreover, any of the various embodiments disclosed herein may be configured to extend all of the way, or at least substantially all of the way, between bottom and top internal surfaces of the safe or, alternatively, may be configured to extend only partially between these surfaces. For example, storage panel 1810 may be configured, depending upon the size of panel 1810 and the size of the firearms or other items being stored on panel 1810, to only extend from or near the floor (or ceiling) of the safe to a mid-portion of the safe. Alternatively, panel 1810 may be positioned to extend along a mid-portion of the safe without extending adjacent to either the floor or the ceiling of the safe.

Any of the various embodiments disclosed herein may be configured such that the storage panel extends parallel to, or at least substantially parallel to, the door of the safe when the door is closed. In this manner, other areas of the safe, such as the interior walls of the safe, may be left unoccupied to allow for storage of other firearms and/or other items and may also allow for the central portion of the safe and/or the portion of the safe immediately behind the door (when closed), which often contains extra space, to be used, or at least used more efficiently.

Thus, some of the embodiments disclosed herein may be configured such that the storage panel sits adjacent to the safe door, but not immediately adjacent to any, or at least two, of the interior walls of the safe, once the panel has been closed and the safe door closed. In other words, the panel may be particularly configured to leave space in between the rear interior wall and one or both of the opposing interior side walls of the safe when the panel is in a closed position so as to allow for placement of firearms, accessories, or other items along each of these walls.

For example, as shown in FIG. 17, the panel may extend perpendicularly, or at least substantially perpendicularly, from one interior sidewall (left side from the perspective of this view) such that the other two walls have space for storing items. More particularly, in this particular embodiment, firearms may be along the entire rear interior wall and the entire right interior wall, if desired. Since only a portion of the left interior sidewall is occupied, items could be stored there as well. Thus, by extending the storage panel into or towards the center, or towards approximately the center and/or a central region, of an interior compartment of the safe, additional opportunities for maximizing efficient use of space with the safe may be provided.

As seen in the drawings, some embodiments may be configured such that the swinging/rotating panel opens in a direction opposite from the safe door. Thus, a user may have three separate storage areas upon opening the safe door and the panel (one on the panel, one inside the safe, and one on the inside of the safe door, as shown in FIG. 1, for example.

Some preferred embodiments may also, or alternatively, be configured such that the storage panel is configured to be repositioned between the open position and the closed position solely by rotating the interior storage panel about a pivot axis. In other words, some embodiments may be configured such that additional actions, such as pulling or otherwise sliding the panel along a track, are not required in order to reposition the panel between these two configurations.

Throughout this specification, any reference to "one embodiment," "an embodiment," or "the embodiment" means that a particular feature, structure, or characteristic described in connection with that embodiment is included in at least one embodiment. Thus, the quoted phrases, or variations thereof, as recited throughout this specification are not necessarily all referring to the same embodiment.

Similarly, it should be appreciated that in the above description of embodiments, various features are sometimes grouped together in a single embodiment, figure, or description thereof for the purpose of streamlining the disclosure. This method of disclosure, however, is not to be interpreted as reflecting an intention that any claim require more features than those expressly recited in that claim. Rather, inventive aspects lie in a combination of fewer than all features of any single foregoing disclosed embodiment. It will be apparent to those having skill in the art that changes may be made to the details of the above-described embodiments without departing from the underlying principles set forth herein. Accordingly, this disclosure is to be regarded in an illustrative rather than a restrictive sense, and all such modifications are intended to be included within the scope thereof. Likewise, benefits, other advantages, and solutions to problems have been described above with regard to various embodiments. However, benefits, advantages, solutions to problems, and any element(s) that may cause any benefit, advantage, or solution to occur or become more pronounced are not to be construed as a critical, a required, or an essential feature or element.

The invention claimed is:

1. A safe, comprising:

a safe door; and an interior storage panel configured to be positioned between a closed position and an open position by rotating the interior storage panel, wherein the interior storage panel is configured so as to be positioned within the safe in the closed position such that the safe door can be closed in the closed position, wherein the interior storage panel is configured so as to be positioned at least partially outside of the safe in the open position when the safe door is open, and wherein the interior storage panel is configured so as to extend along and be positioned at least substantially parallel to the safe door in the closed position with the safe door closed, and wherein the interior storage panel is configured to extend at least substantially along an entire length of the safe from an upper portion of the safe to a lower portion of the safe.

2. The safe of claim 1, wherein the interior storage panel is configured to be repositioned between the open position and the closed position solely by rotating the interior storage panel about a pivot axis.

3. The safe of claim 1, wherein the interior storage panel further comprises a plurality of pivot joints, and wherein the interior storage panel is configured to be repositioned between the open position and the closed position by rotating the interior storage panel about a plurality of pivot axes corresponding with the plurality of pivot joints.

4. The safe of claim 1, further comprising:

a hinge; and a panel coupling member coupled to the hinge and coupled to the interior storage panel.

5. The safe of claim 4, wherein the panel coupling member is configured such that the interior storage panel can be positioned entirely outside of the safe in the open position.

6. The safe of claim 4, wherein the panel coupling member comprises an L-shaped coupling member.

7. The safe of claim 4, further comprising:

a second hinge; and a second panel coupling member coupled to the second hinge and coupled to the interior storage panel.

8. The safe of claim 1, wherein the interior storage panel comprises an open structure comprising a frame defined by at least one frame member.

9. The safe of claim 8, wherein the frame comprises a plurality of frame members.

10. The safe of claim 8, wherein the interior storage panel further comprises an upper panel member and a lower panel member, and wherein the interior storage panel is configured to receive a plurality of firearms extending from the lower panel member to the upper panel member.

11. The safe of claim 10, wherein the upper panel member comprises a plurality of openings configured to receive barrels of firearms.

12. The safe of claim 11, wherein the lower panel member comprises a plurality of grooves, wherein each of the plurality of grooves is configured to receive the buttstock of a firearm.

13. A safe, comprising:

an interior compartment defined at least in part by a rear wall and two opposing sidewalls;

a safe door configured to enclose the interior compartment when closed; and an interior storage panel configured to be positioned between a closed position in which the interior storage panel is positioned within the safe such that the safe door can be closed and an open position in which the interior storage panel is positioned at least partially outside of the safe when the safe door is open, wherein the interior storage panel is configured to be repositioned between the open position and the closed position solely by rotating the interior storage panel about a pivot axis.

14. The safe of claim 13, wherein the interior storage panel is configured so as to extend at least substantially perpendicularly from at least one of the two opposing sidewalls in the closed position.

15. The safe of claim 13, wherein the interior storage panel is configured so as to avoid extending immediately adjacent to at least two of the rear wall and opposing sidewalls of the interior compartment in the closed position.

16. The safe of claim 13, wherein the interior storage panel is configured so as to extend into and occupy a central region of the interior compartment in the closed position.

17. The safe of claim 13, wherein the interior storage panel is configured so as to extend along and be positioned at least substantially parallel to the safe door in the closed position with the safe door closed.

18. The safe of claim 17, wherein the safe door further comprises means for storage of firearms and/or firearms accessories, wherein the means for storage of firearms and/or firearms accessories is positioned on an interior surface of the safe door, and wherein the interior storage panel is configured so as to extend along and be positioned adjacent to the safe door in the closed position with the safe door closed such that sufficient room is provided between the safe door and the interior storage panel to accommodate the means for storage of firearms and/or firearms accessories.

19. The safe of claim 13, wherein the interior storage panel is configured so as to be repositionable between the closed position and the open position by pivoting the interior storage panel in a direction opposite from a direction in which the safe door pivots when the safe door is being opened.

20. A gun safe, comprising:

an interior compartment defined at least in part by a rear wall and two opposing sidewalls;

a safe door configured to enclose the interior compartment when closed;

an interior storage panel comprising an open structure defined by a frame, wherein the interior storage panel is configured to be positioned between a closed position in which the interior storage panel is positioned within the safe such that the safe door can be closed and an open position in which the interior storage panel is positioned at least partially outside of the safe when the safe door is open, wherein the interior storage panel is configured to be repositioned between the open position and the closed position solely by rotating the interior storage panel about a pivot axis, wherein the interior storage panel is configured to store a plurality of firearms, and wherein the interior storage panel comprises:

an upper panel member configured to receive barrels of the plurality of firearms;

a lower panel member configured to received buttstocks of the plurality of firearms, wherein the interior storage panel is configured to receive a plurality of firearms extending from the lower panel member to the upper panel member; and at least one frame member extending between the upper panel member and the lower panel member; and at least one panel coupling member coupled to the at least one frame member and coupled to the gun safe so as to allow the interior storage panel to be rotated about the pivot axis between the open position and the closed position.

* * * * *